US009326629B2

(12) United States Patent
Elstein

(10) Patent No.: US 9,326,629 B2
(45) Date of Patent: May 3, 2016

(54) BOOT HANGER SYSTEMS AND METHODS

(71) Applicant: Andrew J. Elstein, Easton, PA (US)

(72) Inventor: Andrew J. Elstein, Easton, PA (US)

( * ) Notice: Subject to any disclaimer, the term of this patent is extended or adjusted under 35 U.S.C. 154(b) by 0 days.

(21) Appl. No.: 14/396,024

(22) PCT Filed: Jul. 22, 2013

(86) PCT No.: PCT/US2013/051477

§ 371 (c)(1),
(2) Date: Oct. 21, 2014

(87) PCT Pub. No.: WO2014/031266

PCT Pub. Date: Feb. 27, 2014

(65) Prior Publication Data

US 2015/0164257 A1 Jun. 18, 2015

Related U.S. Application Data

(60) Provisional application No. 61/692,059, filed on Aug. 22, 2012.

(51) Int. Cl.
*A47F 7/08* (2006.01)
*A47G 25/00* (2006.01)
*A47G 25/18* (2006.01)

(52) U.S. Cl.
CPC ..... *A47G 25/005* (2013.01); *A47G 25/183* (2013.01); *A47G 25/186* (2013.01)

(58) Field of Classification Search
CPC ..... A47G 25/005; A47G 25/18; A47G 25/32; A47L 23/20
USPC ..... 211/34
See application file for complete search history.

(56) References Cited

U.S. PATENT DOCUMENTS

| | | | | | |
|---|---|---|---|---|---|
| 283,418 | A | * | 8/1883 | Ries | 248/303 |
| 1,270,811 | A | * | 7/1918 | Garant | 211/34 |
| 1,310,281 | A | * | 7/1919 | Clark | 12/116.8 |
| 1,422,782 | A | * | 7/1922 | Rattan | 223/89 |
| 1,470,280 | A | * | 10/1923 | McCulloch | 24/540 |
| 2,192,167 | A | * | 3/1940 | Bagley et al. | 211/113 |
| 2,214,536 | A | * | 9/1940 | Nelson | 223/96 |
| 2,267,634 | A | * | 12/1941 | Arenz | 211/34 |
| 2,287,473 | A | * | 6/1942 | Glines | 211/113 |
| 2,391,661 | A | * | 12/1945 | Watkins et al. | 223/88 |
| 2,679,937 | A | * | 6/1954 | Fulster | 211/34 |

(Continued)

FOREIGN PATENT DOCUMENTS

| | | | | |
|---|---|---|---|---|
| FR | 2787309 | A1 * | 6/2000 | A47G 25/00 |
| WO | 2011010890 | A2 | 1/2011 | |

*Primary Examiner* — Joshua Rodden
*Assistant Examiner* — Kimberley S Wright
(74) *Attorney, Agent, or Firm* — Fish & Tsang LLP

(57) ABSTRACT

The present invention is directed to a boot hanger and a boot hanger system and methods that provide for storage of boots. In an example, a boot hanger apparatus comprises an upper suspension portion and a boot support leg, wherein the upper suspension portion and boot support leg are connected by a counterbalance. The counterbalance is provided to control rotation and preferably to maintain a target slope angle Θ when a suspended boot hanger contains boots in a loaded condition. Further provided are coupler apparatus for forming a series of connected boot hangers suspended along a common vertical axis. In some examples, the boot hanger includes a hook-shaped suspension portion for attachment to a suspension apparatus such as a rod or a coupler within a series of connected boot hangers.

18 Claims, 16 Drawing Sheets

(56) References Cited

U.S. PATENT DOCUMENTS

| | | | | | |
|---|---|---|---|---|---|
| 2,969,151 | A | | 1/1961 | Krstulovich | |
| 3,276,645 | A | * | 10/1966 | Buzzelli | 223/95 |
| 3,346,150 | A | * | 10/1967 | Clopton | 223/95 |
| D231,965 | S | * | 7/1974 | Gutestam | D6/317 |
| 4,129,218 | A | * | 12/1978 | Koellner | 211/116 |
| 4,278,177 | A | * | 7/1981 | Fahmi | 211/116 |
| D297,483 | S | * | 9/1988 | Yann-San | D6/315 |
| 4,972,961 | A | * | 11/1990 | Roesch | 211/116 |
| 5,074,445 | A | | 12/1991 | Chen | |
| 5,083,691 | A | | 1/1992 | Handrick | |
| 5,114,017 | A | * | 5/1992 | Doyel | 211/34 |
| 5,224,607 | A | * | 7/1993 | Koresko | 211/34 |
| D357,813 | S | * | 5/1995 | Koresko | D6/317 |
| 5,778,556 | A | * | 7/1998 | Ohsugi | 34/106 |
| 6,047,867 | A | * | 4/2000 | Heiber | 223/96 |
| 6,123,238 | A | * | 9/2000 | Dumplet | 223/1 |
| D435,174 | S | * | 12/2000 | Grisdale et al. | D6/327 |
| D438,022 | S | * | 2/2001 | Bunn | D6/317 |
| 6,464,087 | B1 | * | 10/2002 | Klein et al. | 211/35 |
| 6,581,786 | B1 | * | 6/2003 | King et al. | 211/34 |
| D526,131 | S | * | 8/2006 | McGowan | D6/317 |
| 7,469,805 | B2 | | 12/2008 | Lynch | |
| D604,517 | S | * | 11/2009 | Scott et al. | D6/317 |
| 7,793,808 | B1 | * | 9/2010 | Herman et al. | 223/88 |
| D652,639 | S | * | 1/2012 | Ferraro et al. | D6/327 |
| 8,602,228 | B1 | * | 12/2013 | Martinez | 211/100 |
| D701,390 | S | * | 3/2014 | Brindise | D6/317 |
| 9,125,487 | B1 | * | 9/2015 | Gonzalez Ruiz | |
| 2005/0224531 | A1 | * | 10/2005 | Bulovic | 223/85 |
| 2007/0080181 | A1 | * | 4/2007 | Lynch | 223/85 |
| 2013/0240576 | A1 | * | 9/2013 | King | 223/85 |

* cited by examiner 28b
28a
27b
27a
20
24b
24a
21
23
22b
22a
25
26a
26b
32
31b
31a
35b
35a
30b
30a
29
33
34b
34a
15
17
16
18
19

BOOT HANGER SYSTEMS AND METHODS

CROSS-REFERENCE TO RELATED APPLICATIONS

This application hereby claims all benefit, including priority to U.S. Provisional Patent Application No. 61/692,059 filed on Aug. 22, 2012.

BACKGROUND

Many boot hanger devices have been developed in the past to either store or display pairs of boots in various arrangements. Such past boot hangers fail to provide good use of storage space, are difficult to install or relocate within a storage area, are incapable of hanging or storing multiple pairs of boots along a vertical axis, fail to provide an ideal angle for viewing stored boots, fail to provide good support for maintaining the original boot shape, and/or fail to accommodate a variety of boot lengths and weights. One such past boot hanger is shown in Japanese Number 2010115300A dated May 5, 2010 to Takuya et al., (hereafter "Takuya et al.) a copy of the document is attached to the information disclosure statement filed with the present patent application along with an English translation of the abstract. The Takuya et al. abstract and related drawing figures disclose a plurality of hangers (3) arranged along vertical spaces inside the cabinet (S1). Each hanger (3) is inserted into a single supported shoe or boot, thereby making it necessary to provide two separate hangers for each pair of stored shoes or boots. The drawings clearly show that Takuya et al. fails to provide any adjustment means for supporting boots having different shaft lengths, and the mechanical fastening arrangement used to fix the hangers to the cabinet wall makes it difficult or inconvenient for a user to install or relocate the boot hangers. In the embodiments shown by Takuya et al., it would be difficult for any user to slide a soft boot shaft up the fixed boot hanger, particularly with adjacent hangers already loaded with boots.

Another known boot hanger device is shown in U.S. Pat. No. 5,224,607 granted to Koresko on Jul. 6, 1993 (hereafter "Koresko"). Koresko overcomes some of the hanger installation or relocation difficulties encountered with the Takuya et al. teachings by providing a boot hanger (1) attached to a closet rod by a hook (3) that is easily installed or relocated at selected locations along the rod. However, the Koresko hanger includes a support portion (5) having a pair of arm members (53) that are inserted through the boot loops (such loops, commonly also called "inner pulls") to suspend the pair of boots from the hanger (Col. 6, Ln. 17-19). As disclosed, the Koresko hanger cannot be used with boots that don't have inner pulls, and the hanger fails to provide means for suspending additional boot hangers along a vertical axis. Koresko's boot storage arrangement provides poor use of limited closet space because clothing space is diminished when multiple pairs of boots are stored along a closet rod, leaving a large amount of vertical space below the stored boots, and rendering that vertical space wasted and unusable.

U.S. Pat. No. 5,294,007 issued to Edmondson on Mar. 15, 1994 (hereafter "Edmondson") provides some improvement over poor space usage inherent in the Koresko device by providing a boot hanger capable of vertically suspending five pairs of western boots from the top edge of a door, but also with individual boots being suspended from the hanger by their boot loops or inner pulls. A typical interior door measures 80-inches along its length. In an instance where the Edmondson boot hanger system is used to suspend pairs of women's knee length fashion boots rather than western style calf length boots, the Edmondson boot hanger becomes less efficient with respect to good storage space usage. Based on information found on "Wikipedia Free Encyclopedia", such fashionable knee length boots measure between 15-19 inches or greater in height from the boot sole to the top of the boot shaft. In such an instance, the Edmondson hanger system can only hang or suspend a vertical string of about four pair of 15-inch boots and only suspend about three pair of 19-inch boots along an 80-inch door length as compared to various embodiments disclosed in the present specification that are capable of vertically suspending as many as eight pair of either 15-inch or 19-inch high boots along the same 80-inch length irrespective of the boots including inner pulls.

Thus, there remains an unmet need for boot hanger systems and methods that provides improved boot storage, as well as more efficient use of storage space for boots and other clothing items in closets and wardrobes, among other things.

SUMMARY OF THE INVENTION

Accordingly, it is a first object of the present invention to provide a boot hanger system and methods that improve storage space usage and efficiencies.

It is another object of the present invention to provide a boot hanger system that is simple to install or relocate within a storage area.

It is another object of the present invention to provide a boot hanger system and method that suspends a string of boot hangers along a vertical axis.

It is another object of the present invention to provide a boot hanger system and method that can alternatively suspend a row of boot hangers along a horizontal axis.

It is another object of the present invention to provide a boot hanger system and method having uncomplicated means to either add or remove boot hangers in a string of suspended boot hangers.

It is another object of the present invention to provide a boot hanger system and method where each suspended boot hanger is suspended at a target slope angle that provides efficient use of vertical storage space.

It is another object of the present invention to provide a boot hanger system and method that affords support to maintain original boot shape by preventing creasing, wrinkling, and like deformations which diminish boot comfort when worn, longevity, and appearance.

It is another object of the invention to provide a boot hanger system and method that maintains suspended boot hangers at a target slope angle when boot size and boot weight changes.

A still further object of the invention is to provide a boot hanger system and method that provides quick and easy boot removal.

A boot hanger apparatus comprising an upper suspension portion and a boot support leg, wherein the upper suspension portion and boot support leg are connected by a counterbalance. Optionally, the at least one boot support leg comprises two boot support legs. Optionally, each boot support leg comprises an upturned foot portion, the foot portion configured for engaging the instep of a boot when said boot is placed on a boot support leg. Optionally, the counterbalance operates to maintain the boot support leg within a desired offset angle ($\Theta$) from a horizontal plane when a boot is placed on the boot support leg. Preferably, the offset angle $\Theta$ is less than about 65 degrees from the horizontal plane.

BRIEF DESCRIPTION OF THE DRAWINGS

The present invention will hereinafter be described in conjunction with the appended drawing figures wherein like numerals denote like elements, for example, wherein elements 1, 101, 201, 301, 401, 501, 601, and 701 each correspond to a "boot hanger."

DETAILED DESCRIPTION

Figure 1:
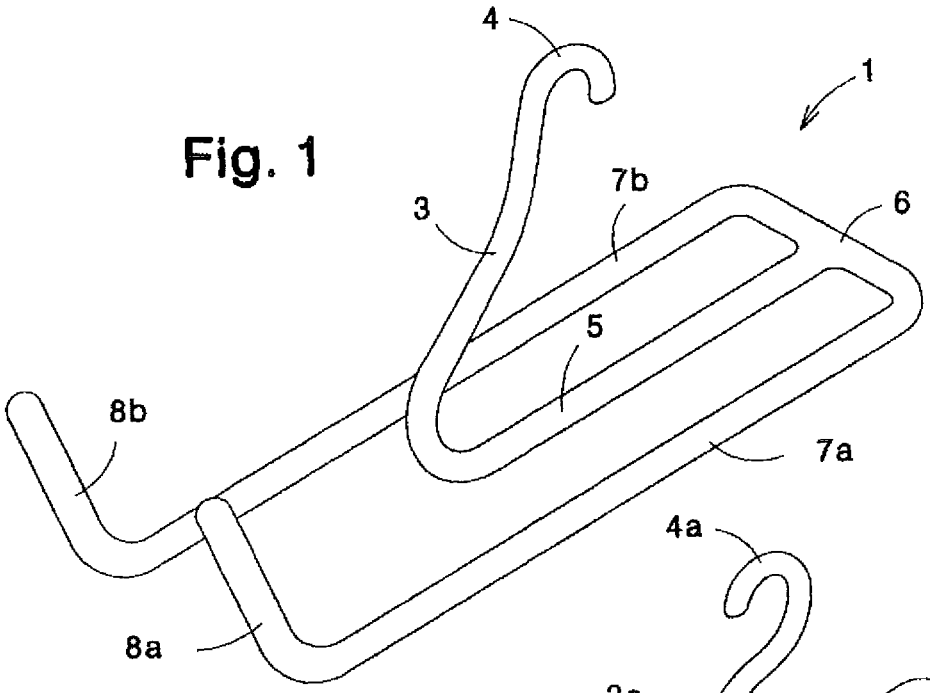
FIG. 1 is an isometric view showing one embodiment of a boot hanger

The present invention is directed to a boot hanger and a boot hanger system and methods that suspends one or more boot hangers along a vertical axis to take full advantage of available space within a storage area. Note that this specification makes reference to the above-described drawings, including reference to numbered elements described herein and depicted in the drawings. The reader is instructed that like numerals denote like elements, such as by adopting a series across differing embodiments having the same or similar elements. For example, wherein elements 1, 101, 201, 301, 401, 501, 601, and 701 each correspond to a "boot hanger". Therefore, reference numerals that are introduced in the specification in association with a drawing figure may be repeated in one or more subsequent figures without additional description in the specification in order to provide context for other features. In the absence of a particular description of each feature in this specification, the series numbering method and figures are fully enabling to anyone skilled in the art concerning the inventions described and claimed herein.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way.

As used herein, the term "anterior" refers to a location along the outward facing side of a closet rod (towards a user standing in front of the closet rod).

The term "posterior" refers to a location along the opposite side from the anterior side, towards the closet wall, and away from a user standing in front of the closet rod.

As also used herein, the term "forward" refers to a direction or location along or adjacent to the anterior side of a closet rod, while the term "rearward" refers to a direction or location along or adjacent to the posterior side of a closet rod.

As used herein, "counterbalance" means any apparatus that maintains the boot hanger apparatus in a desired position relevant to a horizontal axis or plane (Y-Y), such as when boots are installed on the boot hangar apparatus, as further described herein.

Referring to the drawings, in FIGS. 1, 2, 3, and 4, one embodiment of the present boot hanger system and methods is illustrated. As shown, that embodiment comprises at least one boot hanger 1 configured for hanging from a suspension apparatus 2, such as a shelf, beam, ceiling, door, closet rod, or other suspension apparatus known to be provided in the structure of known closets, wardrobes, and the like. By way of further non-limiting disclosure, "suspension apparatus" can include any of couplers, closet rods, hooks, pins, nails, bolts, shelves, lashings, ropes, cables, chains, clothes lines, trees, limbs, joists, rods, tubes, loops, rings, ball joints, and the like.

In satisfaction of the foregoing objects and advantages, the present invention includes a boot hanger and a boot hanger system and methods that provide for a series or "string" of boot hangers suspended along a common vertical axis, each boot hanger including a hook or other suitable suspension portion for attachment to a suspension apparatus such as a closet rod, or alternatively and additionally to another boot hanger or coupler in the string of boot hangers, a counterbalance assembly extending from the hook and including support legs for hanging a pair of boots, the counter balance assembly provided to control rotation and maintain a target slope angle theta Θ, such as when a hung pair of boots cause an unbalanced load on the boot hanger in use.

Figure 3:
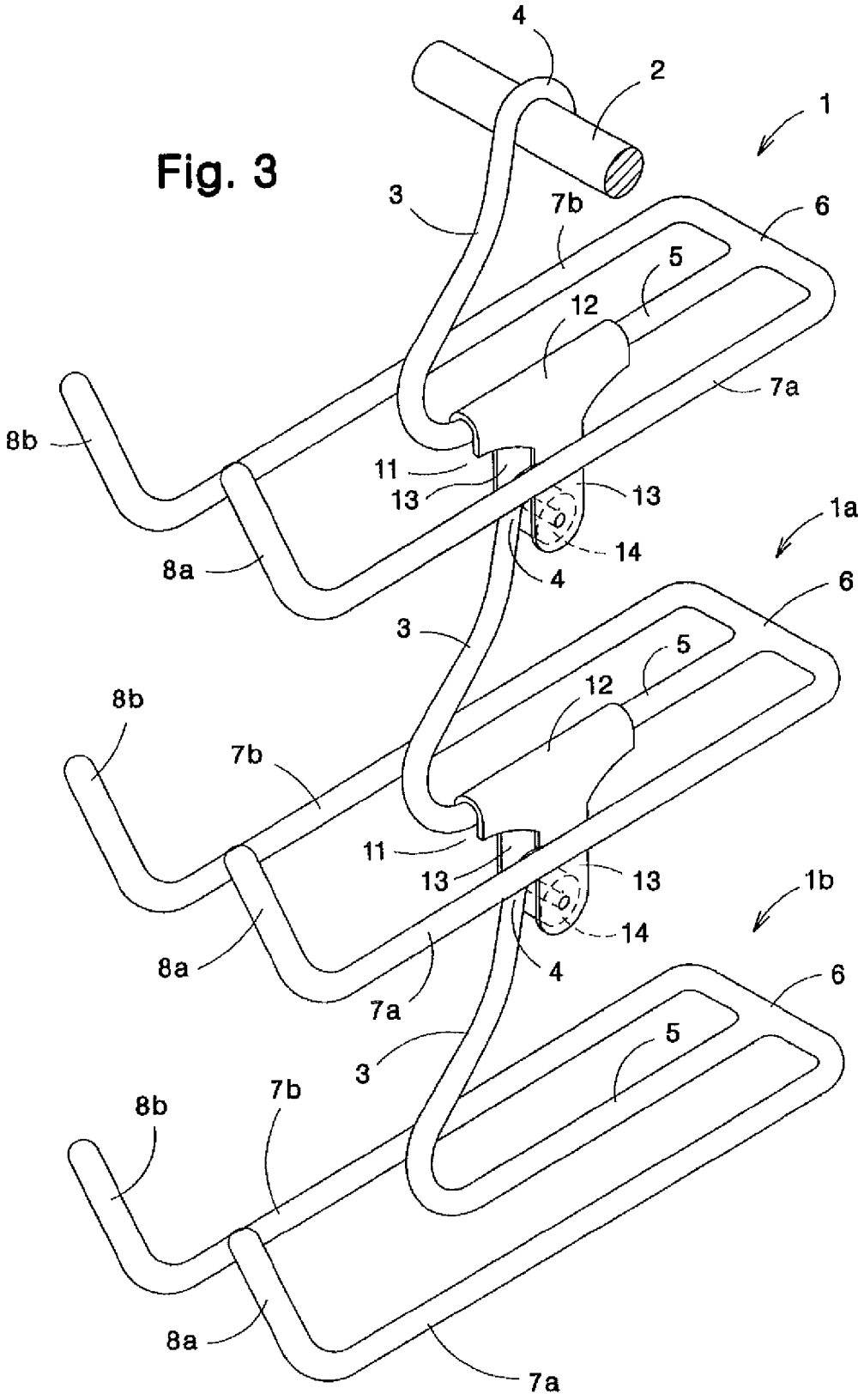
FIG. 3 is an isometric view showing the boot hanger of FIG. 1 used in the present boot hanger system.

In an example, the boot hanger 1 includes a suspension portion 4 configured for attachment to the suspension apparatus 2 (shown in FIG. 3 as a closet rod). Notably, the suspension apparatus 2 can be any type, and can be located above or below the boot hanger 1, such as in the non-limiting examples of a shelf or closet rod above the boot hanger, or a rod or other rigid vertical support extending from a floor or other support surface located below the boot hanger 1. The suspension portion 4 can include any permanent, temporary, and/or removable attachment means for engaging the suspension apparatus 2, whether a loop, strap, band, wire, hook, or other known attachment means. In FIGS. 1-21, the suspension portion 4 is shown as a hook-shaped portion configured to engage a suspension apparatus 2 to thereby attach the boot hanger 1 to the suspension apparatus 2 (such as a closet rod). In any embodiment, the boot hanger 1 includes a counterbalance 3. Referring again to FIGS. 1-3, the counterbalance 3 is illustrated as being positioned below and along the anterior side of the hook-shaped suspension portion 4. In this embodiment, the counterbalance 3 further includes a counterbalance arm 5 that extends from the anterior side of hook-shaped suspension portion 4 towards the posterior side of the suspension portion 4. In this embodiment, counterbalance arm 5 terminates at a T-shaped posterior end member 6 that is positioned along the posterior side of hook shaped suspension portion 4. The T-shaped posterior end member 6 is also connected to first boot support leg 7*a* that extends in a forward direction, and that is connected to an upward angled foot 8*a* positioned along the anterior side of hook-shaped suspension portion 4. As shown in FIG. 1, the opposite end of T-shaped posterior end 6 is connected to a second boot support leg 7*b* that extends in a forward direction and terminates in an upward angled foot 8*b*. Note that each foot 8*a*, 8*b* is positioned along the anterior side of hook-shaped suspension portion 4 at a location anterior to counterbalance arm 5, and that each boot support leg 7*a*, 7*b* and foot 8*a*, 8*b* are spaced apart from one another and from counterbalance arm 5 so as to provide adequate room to slide the open end of a boot 9 over each foot 8*a*, 8*b* and over each leg 7*a*, 7*b*.

Figure 4:
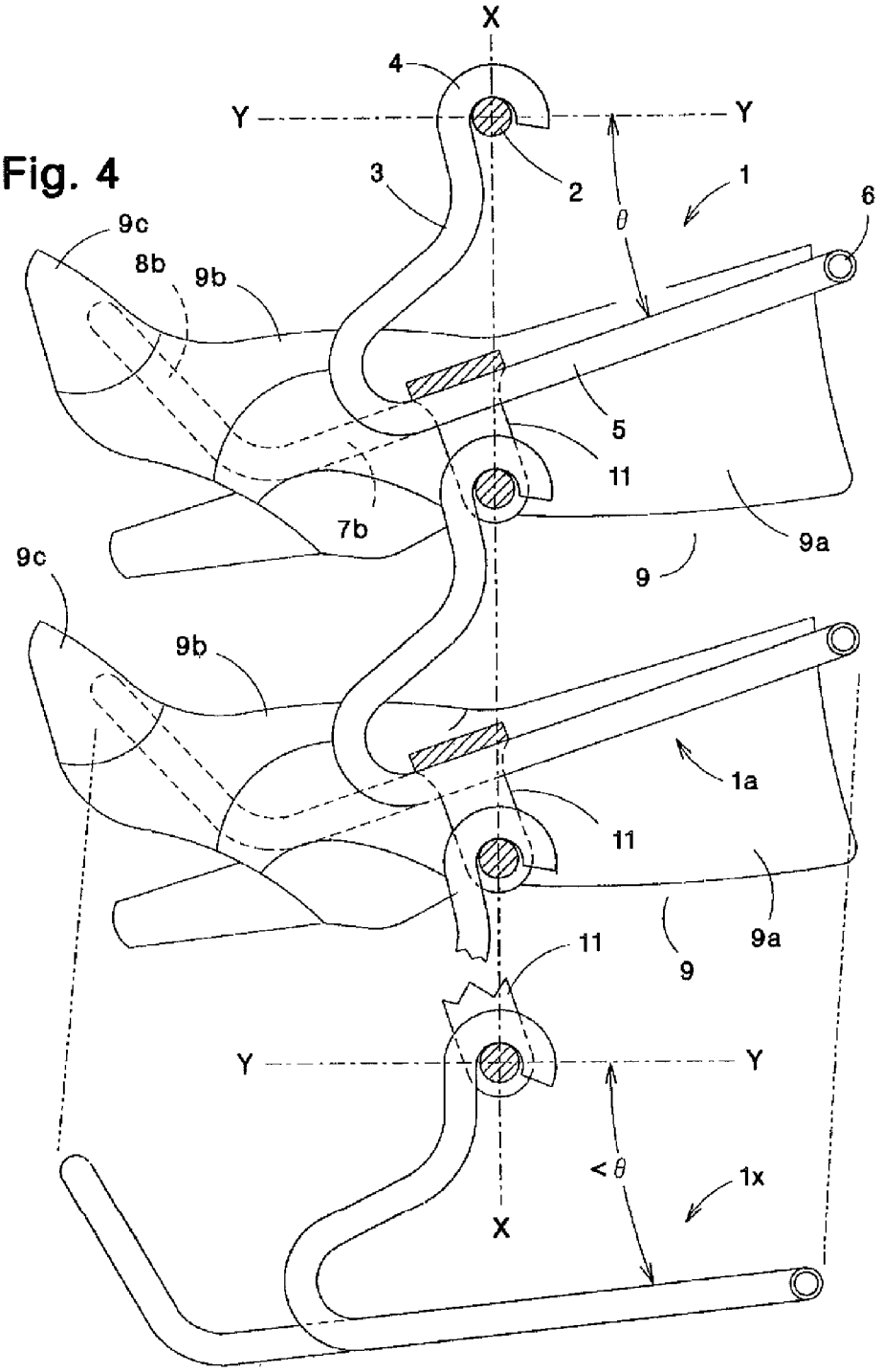
FIG. 4 is a cross-section view taken along the lines 4-4 in FIG. 2.
Figure 19:
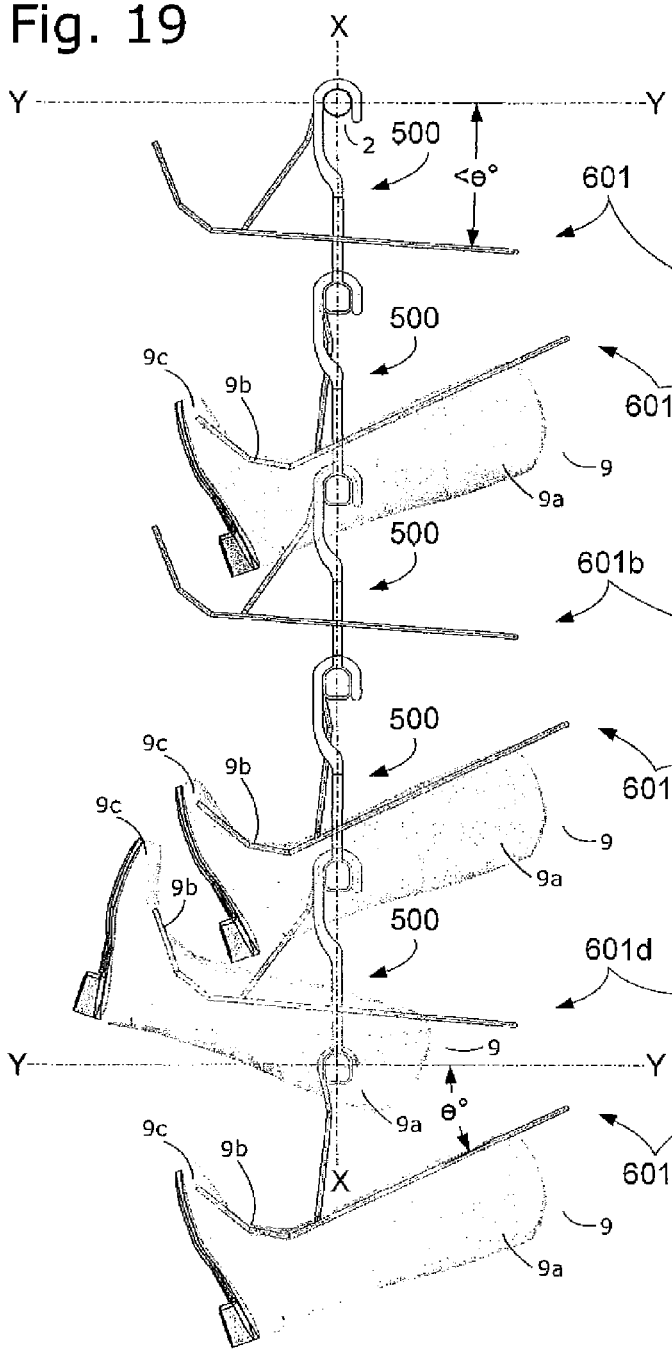
FIG. 19 is a right side orthographic view with transparency showing embodiments of the present invention and particularly illustrating the way in which the hangers rotate about the support on which they are suspended causing the boot support legs and upward angled feet which are setout from the axis of rotation to clear adjacent boot hangers and boots suspended thereon, thereby permitting easy boot insertion and removal.
Figure 20:
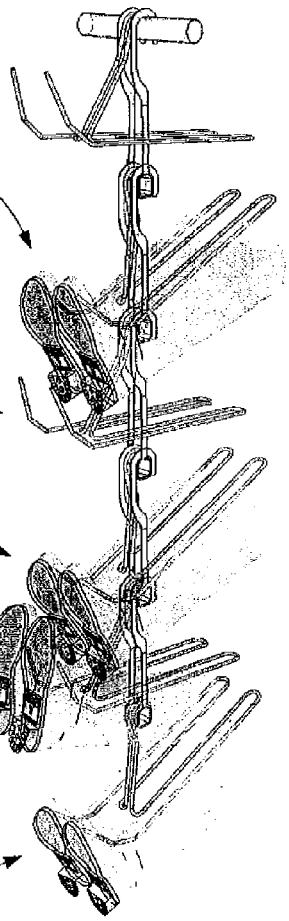
FIG. 20 is an isometric view showing exactly the same embodiments, composition and transparency as FIG. 19.

Both the support legs 7*a* and 7*b* and the upward angled feet 8*a* and 8*b* include effective lengths so that legs 7*a* and 7*b* adequately support one or more boots 9. As shown in FIGS. 19-20, for example, each boot 9 includes a shaft portion 9*a*, instep portion 9*b*, and toe portion 9*c*. When a boot is installed onto hanger 1, the respective leg 7 and foot 8 engage the interior of the boot 9, such as the angled foot 8*a* engaging the instep portion 9*b*, and thereby holding the toe portion 9*c* in an upward direction, while preventing shafts 9*a* from sliding along the support leg 7 so that the shape of boot 9 is maintained and the boot is resiliently retained on the hanger. As shown in FIG. 4, the counterbalance 3 and posterior end member 6, along with posterior portions of each support leg 7, control rotational force exerted on hook-shaped suspension portion 4 when a pair of boots 9 are longitudinally hung on the support legs 7*a* and 7*b* so that the entire loaded boot hanger 1 rotates about its hook-shaped suspension portion 4 about the suspension apparatus 2 (here shown as a closet rod) to a desired target downward inclined plane or slope angle, such as angle theta Θ offset from a horizontal plane. The combined length and weight of counterbalance 3, posterior end member 6, and the posterior portions of boot support legs 7*a* and 7*b* and the center of mass of the suspended boot hanger 1 are predetermined so that boot hanger 1 is rotated to a downward inclined plane having a target slope angle theta Θ when loaded with a pair of boots 9, as shown in FIG. 4. In this loaded condition, where legs 7*a* and 7*b* are within the shafts 9*a* of hanging boots with the angled feet 8*a* and 8*b* engaging the instep 9*b* of each boot to hold the toe 9*c* in an upward direction, as shown at boot hangers 1 and 1*a* in FIG. 4, a target slope angle theta Θ will vary depending upon the weight distribution of the boots being supported but is preferably less than about 65 degrees below the horizontal axis Y-Y with a preferred target slope angle theta Θ of about 25 degrees, and preferably at least greater than about 1 degree. Such a preferred shallow target slope angle improves vertical storage space usage by allowing a greater number of boot hangers 1 to be suspended along a vertical axis X-X when compared to prior boot hanger devices as heretofore mentioned above. In an unloaded condition, without hung boots, as shown at boot hanger 1*x* in FIG. 4, the slope angle of the boot hanger is smaller than (or less than) the target slope angle theta (i.e., "<Θ" as labeled in the Figures.)

As previously described, the counterbalance operates to maintain the boot support leg 7 within a desired offset angle (Θ) from a horizontal plane when a boot 9 is placed on the boot support leg 7. Preferably, the offset angle Θ is less than about 65 degrees from the horizontal plane. Preferably, the boot support leg 7 further comprises an upturned foot portion, the foot portion 8 configured for engaging the instep 9*a* of a boot 9 when said boot 9 is placed on a boot support leg 7 and the offset angle Θ is less than the angle of the upturned foot portion 8, such that the upturned foot is still pointed in an upward direction, once the hanger is loaded and has rotated to the target offset angle Θ. Optionally, the boot support legs 7*a*, 7*b* are setout from the axis of rotation by greater than about 13 centimeters, and preferably by greater than about 15 to about 17 centimeters. In an example, the boot hanger apparatus has an overall length greater than about 39 to greater than about 45 centimeters when measured along the horizontal plane of the support legs. Preferably, the upturned foot portion 8 extends to greater than about 6 to greater than about 8 centimeters above the position of the boot support leg 7 when said boot support leg 7 is oriented along a horizontal plane. Preferably, the upturned foot portion 8 has an offset angle greater than about 25 degrees to greater than about 45 degrees above a horizontal plane.

Figure 1A:
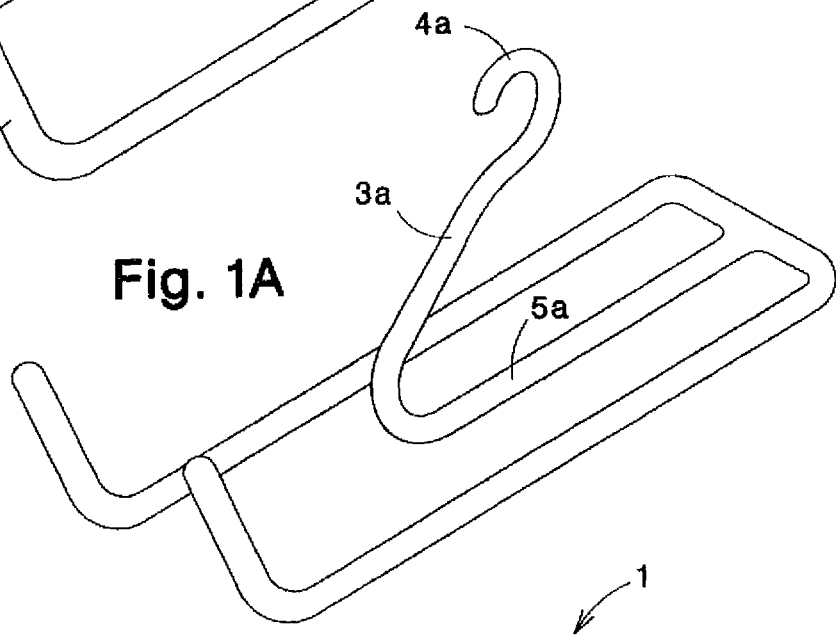
FIG. 1A is an isometric view showing a portion of a boot hanger having an alternate hook embodiment.
Figure 2:
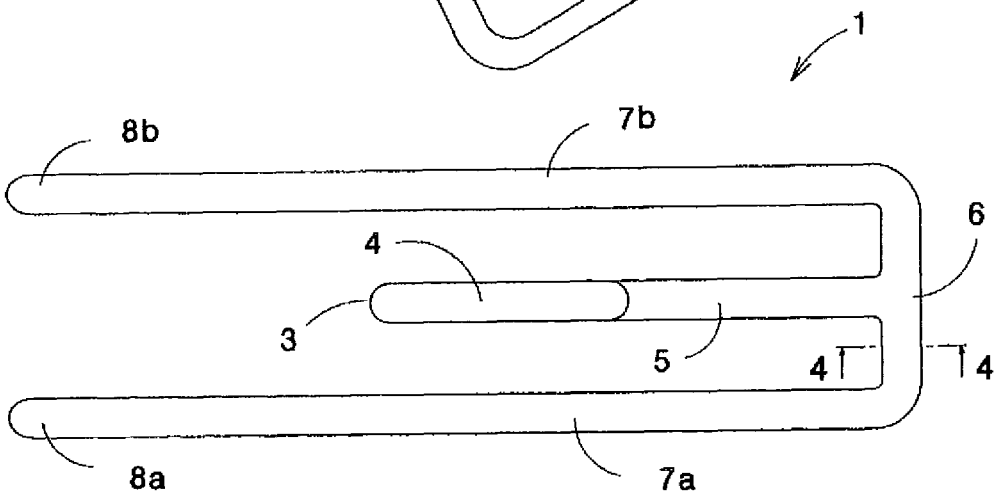
FIG. 2 is a top plan view of the boot hanger shown in FIG. 1.

FIG. 1A shows a boot hanger with an alternate suspension portion 4 being a hook-shaped portion 4*a* inter-connected with a counterbalance 3*a* having a counterbalance arm 5*a*, generally similar to FIG. 1. In FIG. 1A, hook-shaped portion 4*a* is rotated 180° as compared to the hook 4 of FIG. 1. In any embodiment, a suspension portion may comprise a hook-shaped portion 4*a* and additionally or alternatively any suitable suspension portion comprising any temporary or permanent attachment means known in the art suitable to attach the various boot hanger embodiments described herein to a suspension apparatus, such as closet rod 2, without departing from the scope of the present invention.

Referring again to FIG. 4, any suitable suspension portion 4, such as any attachment device or coupler, may be used to attach boot hangers 1 through 1*x* with one another to thereby provide a series or "string" of connected boot hangers suspended along a vertical axis X-X without departing from the scope of the present invention. Such exemplary devices are shown, but are not limited to, the coupler slings and the coupler ladder shown in FIGS. 3-3B, 4, 16, 17, 19, 20, and 22-24. In FIGS. 3 and 4 the boot hanger system uses coupler sling 11 to suspend additional boot hangers 1*a* and 1*b* and boot hangers 1*a* through 1*x* respectively from boot hanger 1 to provide a string of hangers along the X-X axis of the boot hanger system. In such an arrangement, the hook of a first boot hanger 1 is attached directly to the suspension apparatus, such as closet rod 2. A detachable coupler sling 11 having a saddle portion 12 is suspended from the counterbalance arm 5 of boot hanger 1. A pair of parallel legs 13 extends downward from saddle 12 and a rod stub 14 extends between and is fixed to the parallel legs. Coupler sling 11 is suspended from counterbalance arm 5 of boot hanger 1 at a position that aligns rod stub 14 with the vertical X-X axis and boot hanger 1*a* is suspended from rod stub 14. Likewise, second coupler sling 11 is suspended from counterbalance arm 5 of boot hanger 1*a* and boot hanger 1*b* is suspended from rod stub 14. In this manner, the coupling procedure is repeated for each additional boot hanger 1*a*-1*x* that is added to the string of hangers until a last boot hanger in this example, hanger 1*x*, is coupled to the string of hangers. This boot hanger and coupling arrangement and method simplifies adding or removing boot hangers 1*a* through 1*x* as necessary to adapt to differing boot storage needs of any user.

Figures 3A, 3B:
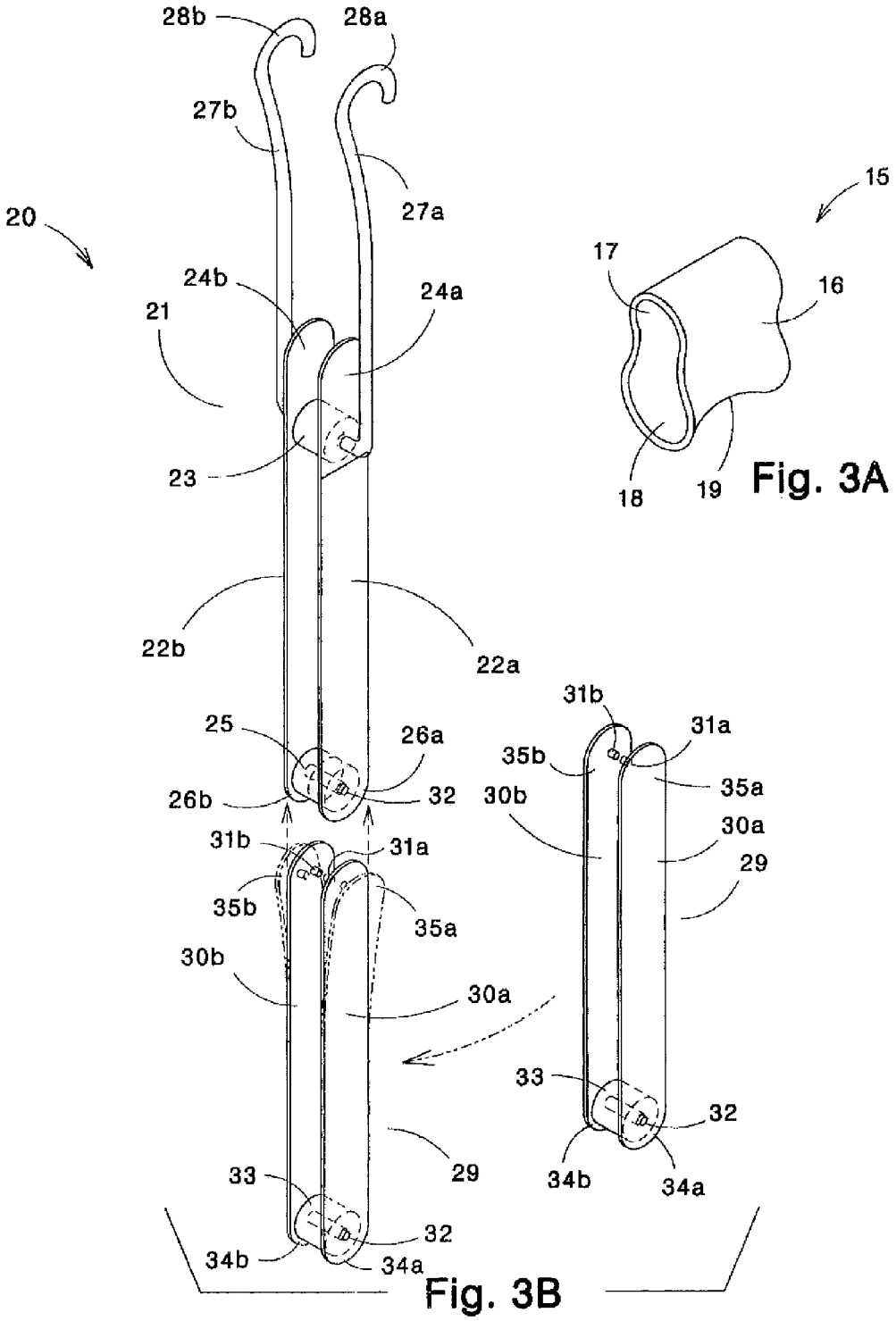
FIG. 3A is an isometric view showing a coupler sling in the present boot hanger system.
FIG. 3B is an isometric view showing a coupler ladder used in the present boot hanger system.

FIG. 3A shows an alternate coupler sling 15 used to suspend boot hangers in the present boot hanger system comprising a continuous loop formed by a sidewall 16 having a first inside diameter 17 extending along the length of wall 16 and adapted to suspend from the counterbalance arm of a boot hanger, and a second larger inside diameter 18 extending along the length of wall 16 and having a curved surface 19 shaped to correspond with and engage the hook of a suspended boot hanger 1*a*-1*x*. The alternate coupler sling 15 is used to attach boot hangers 1*a*-1*x* in a string of suspended hangers, as for example, similar to hangers 1*a* through 1*x* in FIGS. 3 and 4. When used, the first inside diameter end 17 of coupler sling 15 is slipped over the hook of a boot hanger 1 and is then slid downward and onto the counterbalance arm 5 where it is positioned to align the second larger inside diameter 18 portion of the coupler sling 15 with the vertical X-X axis.

A third alternate suspension device for use with the present boot hanger system comprises a coupler ladder assembly 20 as shown in FIG. 3B. The coupler ladder assembly 20 includes standalone coupler ladder 21 having a pair of side rails 22*a* and 22*b*, a first rung 23 that extends therebetween and is fixed to the side rails 22*a*, 22*b* proximate their top ends 24*a* and 24*b*, and a second rung 25 that extends between and is fixed to the side rails 22*a*, 22*b* proximate their bottom ends 26*a* and 26*b*. A pair of coupler ladder attachment arms 27*a* and 27*b* extend in an upward direction from side rails 22*a* and 22*b*, and the attachment arms are shaped to provide a suspension portion such as a hook-shaped suspension portion 28*a* and 28*b* to attach the standalone coupler ladder to a closet rod 2 or the like.

Figure 5:
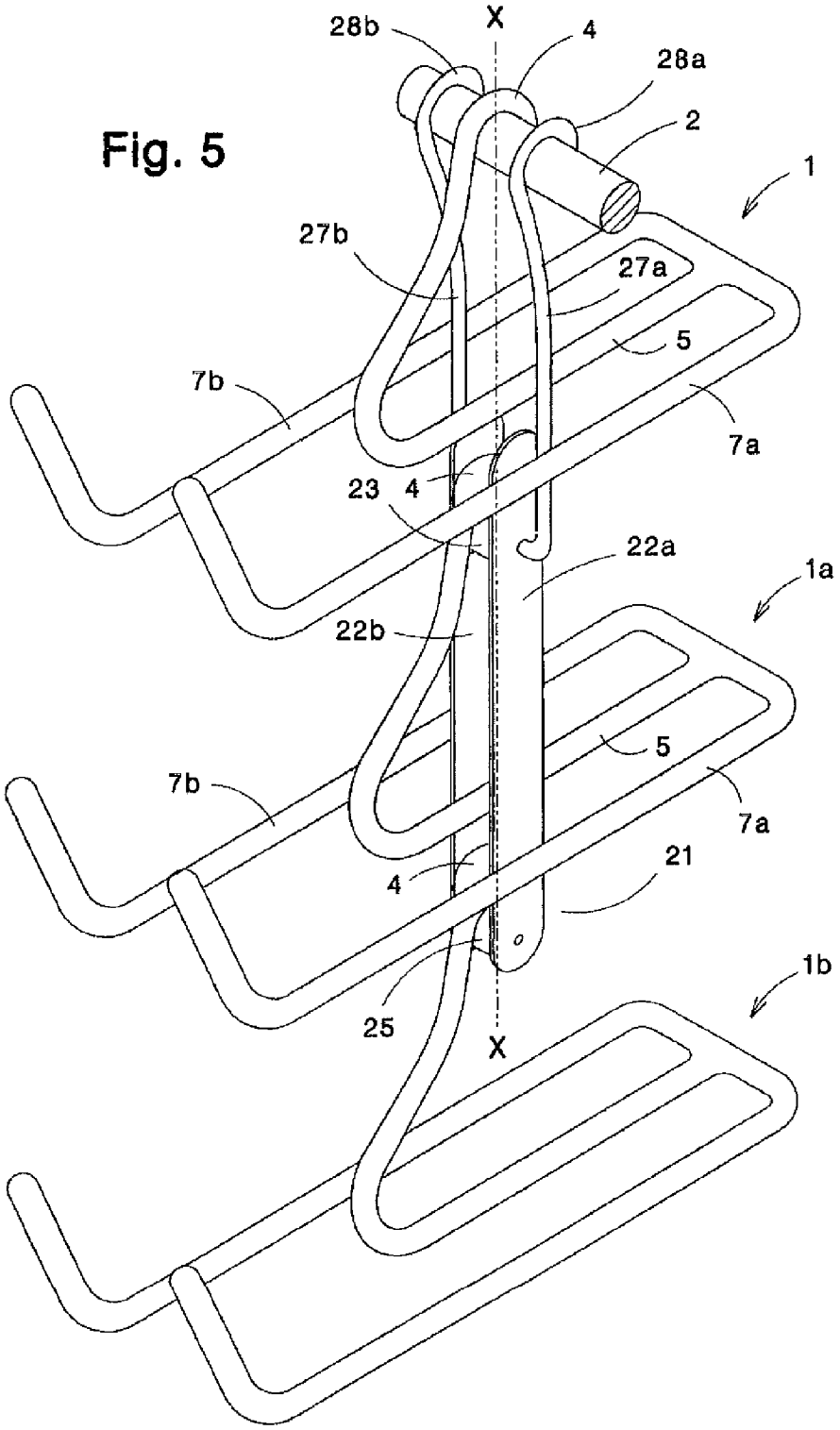
FIG. 5 is an isometric view showing the coupler ladder of FIG. 3B used in the present boot hanger system.

Referring to FIG. 5, showing the stand-alone coupler ladder 20 used to suspend boot hangers 1-1*x*, the spaced apart distance (e.g. side rail width) between side rails 22*a* and 22*b* is greater than the thickness of counterbalance arm 5 so that the counterbalance arm 5 of, in this instance boot hanger 1*a*, can extend between the side rails 22*a*, 22*b* when the suspension portion 4 of the boot hanger 1 is attached to the first rung 23. The distance or gap between the support legs 7*a* and 7*b* is greater than the side rail width so that the support legs extend along opposite sides of the coupler ladder when boot hanger 1*a* is attached to rung 23. Boot hanger 1*b* is shown attached to and suspended from the second rung 25 of stand-alone coupler ladder 20 and the coupler ladder attachment arms 27*a* and 27*b* extend between the hanger 1 boot support legs 7*a* and 7*b*. Boot hangers 1*a* and 1*b* are shown suspended from rungs 23 and 25 respectively with the optional boot hanger 1 shown attached to suspension apparatus 2 (e.g. closet rod) with its counterbalance arm 5 and hook-shaped suspension portion 4 positioned between the attachment arms 27*a* and 27*b* and attachment arm hooks 28*a* and 28*b*.

Referring again to FIG. 3B, the coupler ladder 20 optionally further includes detachable coupler ladder extensions 29 so that boot hangers may be added or removed from a string of suspended boot hangers as storage needs change. Each coupler ladder extension 29 includes a pair of side rails 30*a* and 30*b* with lock pins 31*a* and 31*b* located proximate the upper ends 35*a* and 35*b* of each side rail and positioned to engage and suspend coupler ladder extension 29 from an aperture 32 provided in the standalone coupler ladder 20 or in an adjacent coupler ladder extension 29 when a plurality of coupler ladder extensions 29 are connected to the coupler ladder 20 and its components. Each coupler ladder extension includes a rung 33 for attaching a boot hanger, and the rung extends between and is fixed to the side rails 30*a* and 30*b* proximate their bottom ends 34*a* and 34*b*. The upper portions 35*a* and 35*b* of the side rails 30*a* and 30*b* are resilient or spring like to provide means for attaching the coupler ladder extension to the assembly by inserting the lock pins 31*a* and 31*b* into their corresponding apertures 32. Any number of coupler ladder extensions may be added to or removed from the coupler ladder assembly as boot storage needs change.

Figure 6:
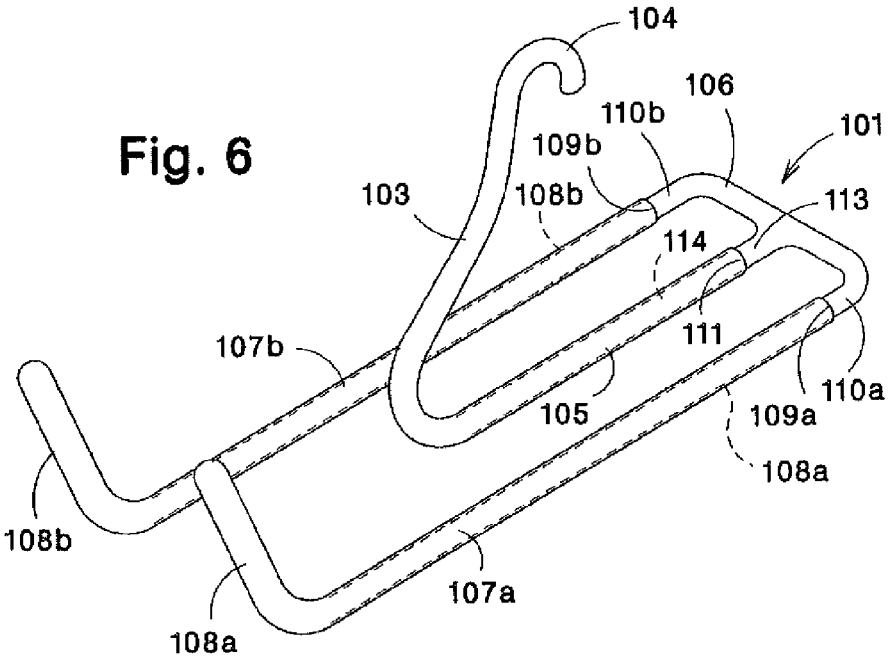
FIG. 6 is an isometric view of a boot hanger similar to FIG. 1 with adjustment means to accommodate boot size and boot weight.
Figure 6A:
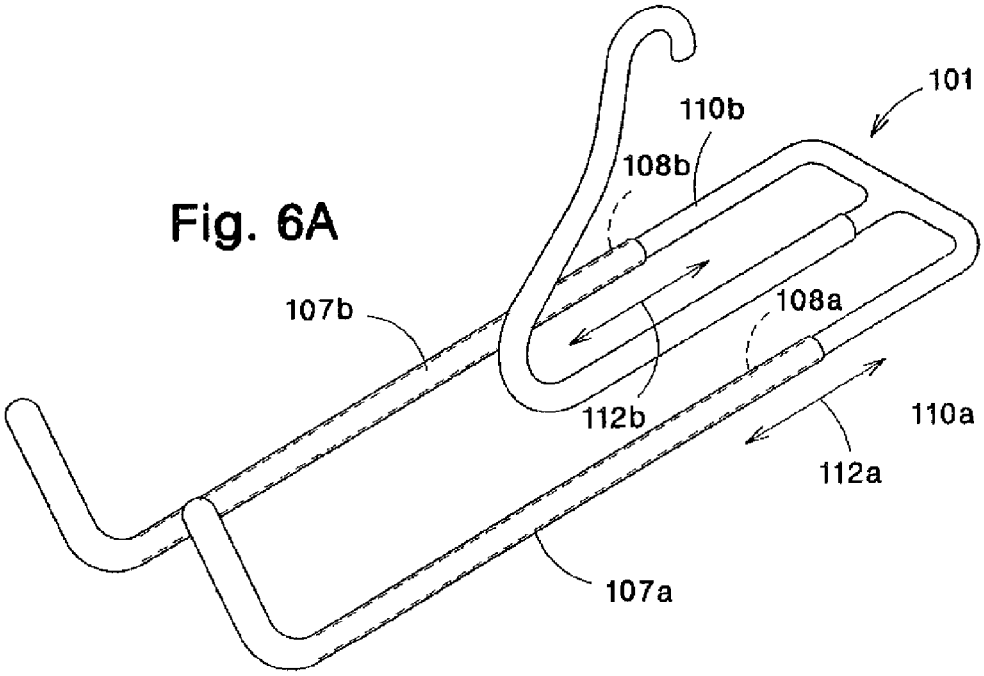
FIG. 6A is an isometric view showing the boot hanger of FIG. 6 adjusted to accommodate boot size.
Figure 6B:
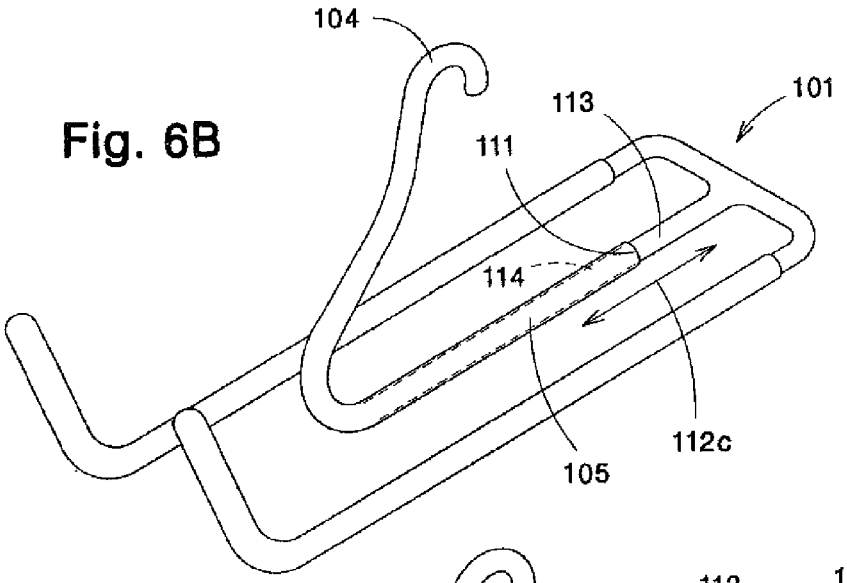
FIG. 6B is an isometric view showing the boot hanger of FIG. 6 adjusted to accommodate boot weight.
Figure 6C:
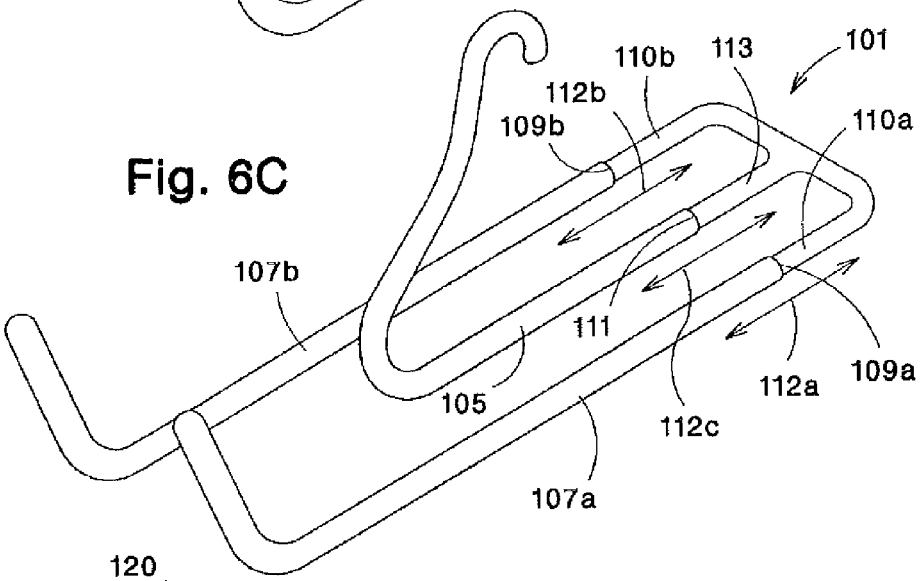
FIG. 6C is an isometric view showing the boot hanger of FIG. 6 adjusted to accommodate both boot size and boot weight.
Figure 7:
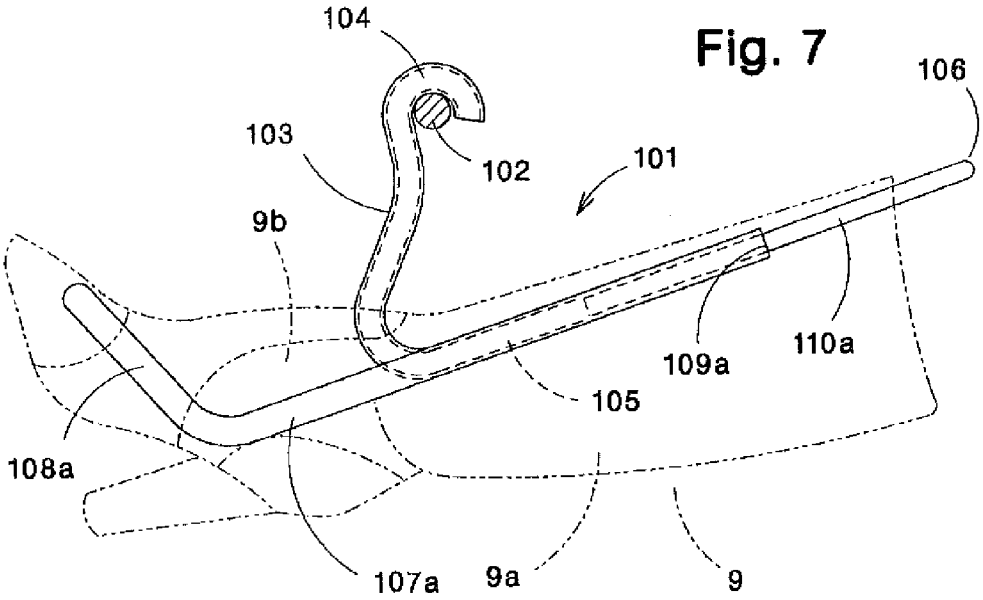
FIG. 7 shows the boot hanger of FIG. 6C inserted into a boot.

FIGS. 6-6C and FIG. 7 of the drawings show an alternate boot hanger embodiment 101, similar to the boot hanger 1 of FIG. 1, but further including adjustment means that allows a user to adjust and accommodate for various boot sizes and boot weights to maintain the desired target downward inclined plane or slope angle theta Θ. As in the above mentioned embodiments, at least one boot hanger 101 is suspended from a suspension apparatus 102 such as closet rod. Boot hanger 101 includes a suspension portion such as a hook shaped suspension portion 104 to engage a closet rod or the like and integral with a counterbalance 103 that includes a counterbalance arm 105 having a "T" shaped posterior end 106 fixed to support legs 107*a* and 107*b*, both support legs terminating in upward angled feet 108*a* and 108*b*, respectively. In any embodiment, note that the posterior end 106 need not be strictly T-shaped, but can additionally or alternatively be arcuate and/or curved, rather than hard angled as in the T-shaped embodiments, so long as the support legs 7, 107 connected to said posterior portion 6, 106 extend forward towards the anterior side of the suspension portion 4, 104.

Referring in particular to FIG. 6, each support leg 107*a* and 107*b* include a telescopic or slide connection 109*a* and 109*b* respectively that enables the length of support legs 107*a* and 107*b* to be selectively either increased or decreased by a user to accommodate boot size. The telescopic connections preferably comprise tubular support leg portions 109*a* and 109*b* having an inside diameter that provides a sliding fit with corresponding rods or tubes 110*a* and 110*b* associated with the posterior end 106. The lengths of support legs 107*a* and 107*b* are increased or decreased to fit a particular boot size by the sliding rods 110*a* and 110*b* within tubular portions 109*a* and 109*b* in either a forward direction or rearward direction to decrease or increase support leg length respectively as shown by the directional arrows 112 shown in FIG. 6A.

Changes in the length of each support 7, 107 to accommodate boot size in combination with boot weight can cause suspended boot hangers 1, 1*a*-1*x* to rotate outside the target slope angle theta Θ. To control boot hanger rotation so that the target slope angle is maintained, the counterbalance arm 105 can include a telescopic or slide connection 111 that enables the length of counterbalance arm 105 to be either increased or decreased, to thereby maintain angle theta Θ. In an embodiment, the telescopic connection of arm 5, 105 comprises a tubular portion 114 having an inside diameter that provides a sliding fit with a corresponding rod or tube 113 associated with the posterior end 106. The sliding fit provides means to maintain the target slope angle theta Θ by sliding the rod portion 113 of counterbalance arm 105 in a forward direction or rearward direction as shown by directional arrow 112*c* in FIG. 6B to maintain the target slope angle theta Θ. Counterbalance arm 105 adjustment is preferably independent of the support leg 107 adjustment and can be done without changing the length of support legs 107*a* and 107*b*.

FIG. 6C and FIG. 7 show the boot hanger 101 adjusted for both boot size and boot weight with the shaft 9*a* of a boot 9 (FIG. 7) supported on the adjusted support legs 107*a* and 107*b* with the angled feet 108*a* and 108*b* engaging the instep 9*b* of the boot.

Figure 6D:
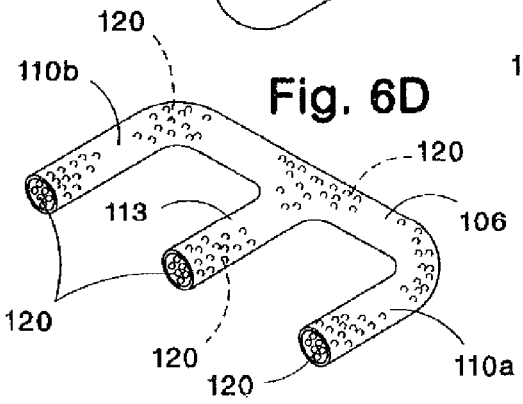
FIG. 6D is a fragmentary view showing one means to add weight to a boot hanger counterbalance.
Figure 6E:
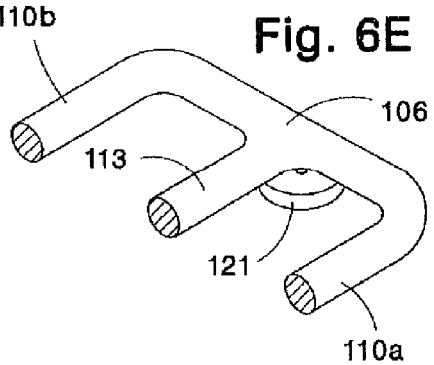
FIG. 6E is a fragmentary view showing additional means to add weight to a boot hanger counterbalance.

Referring to FIGS. 6D and 6E, in addition to, or exclusive of, either increasing or decreasing the length of counterbalance arm 5, 105 and/or support legs 7, 107 to control rotation of the boot hanger about an axis of rotation for the purpose of maintaining the target slope angle Θ, rotation may also be controlled by increasing or decreasing the weight of counterbalance 3, 103 and/or support legs 7, 107. FIG. 6D shows one embodiment for adding weight to a boot hanger 101 having a telescopic or slide connection similar to the features of hangers generally shown in FIGS. 6 and 10. The sliding tubular member 113 of the counterbalance arm 105 and associated posterior end 106, and the sliding tubular members 110*a* and 110*b* are filled with an effective amount weighted matter 120. The effective amount of weighted matter is determined by both the weight of boots hung on the support legs 107*a* and 107*b* and the length and weight of the support legs and counterbalance arm. The weighted matter may comprise steel or lead shot, sand, or other desirably heavy or dense material capable of adding sufficient weight to the counterbalance arm to thereby control rotation and maintain the target slope angle. FIG. 6D shows the sliding tubular members 113, 110*a* and 110*b*, and the tubular posterior end 106 of a telescopic boot hanger containing an effective amount of weighted material, FIG. 6E shows other embodiments for adding weighted matter to telescopic boot hangers. In this instance weight is added by replacing the tubular sliding members 113, 110*a* and 110*b*, and the tubular posterior end 106 with solid or non-tubular portions to add weighted matter and control rotation of the boot hanger about the axis of rotation so that the target slope angle Θ is maintained. Weights 121 may also be attached to the posterior end 106 of the counterbalance to provide an effective amount of weighted matter for controlling rotation and maintaining the target slope angle Θ. Such weights 121 may be added to either tubular or non-tubular posterior ends 106.

It should be understood that although FIGS. 6D and 6E show weighted matter added to telescopic boot hangers, such weighted matter may be added to non-telescopic boot hangers without departing from the scope of the present invention.

Figure 8:
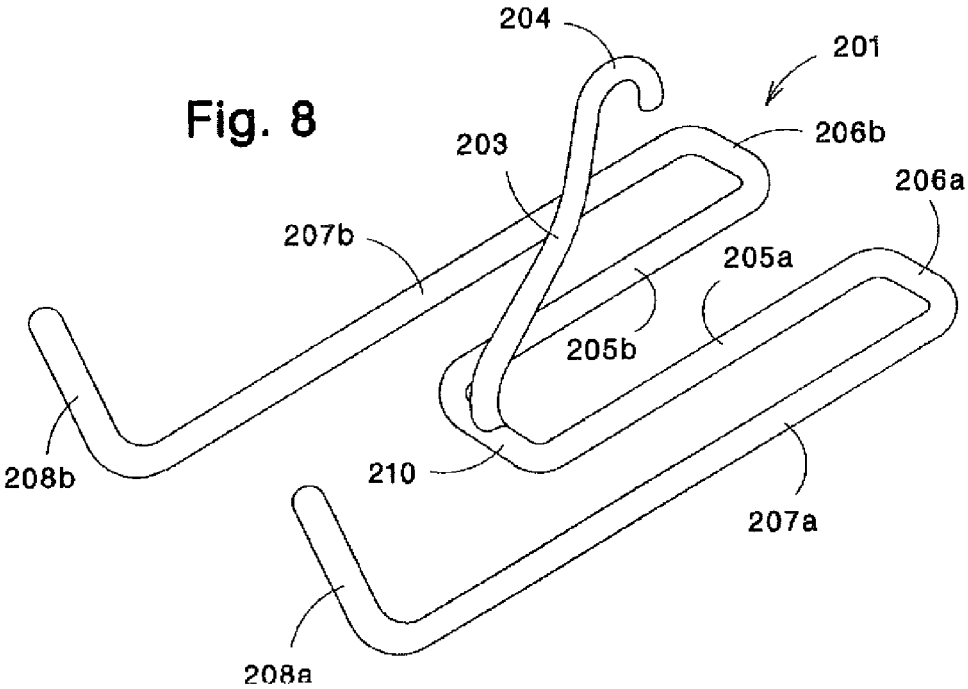
FIG. 8 is an isometric view showing an alternate embodiment of boot hanger for use with a coupler ladder of FIG. 3B.
Figure 9:
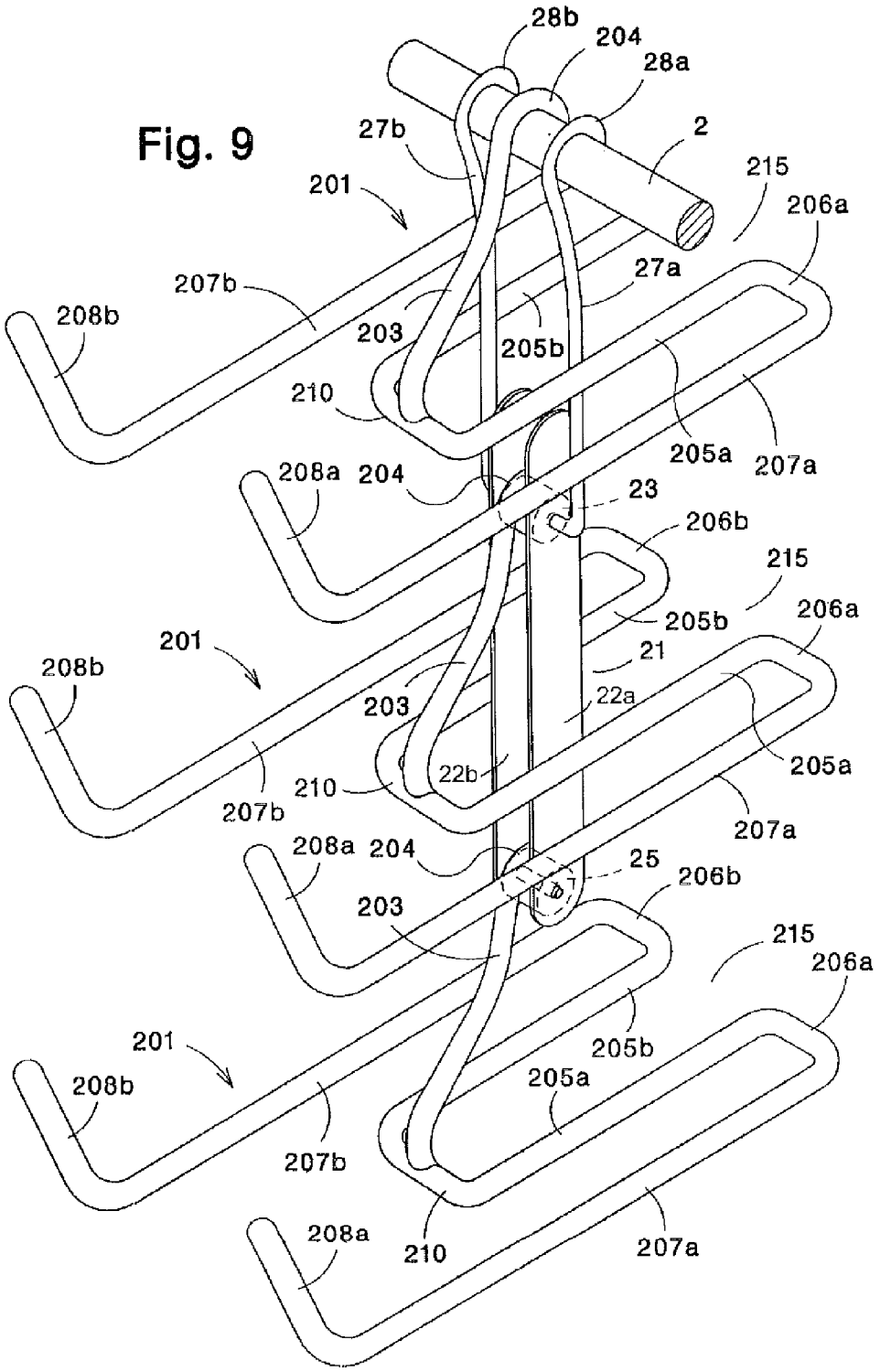
FIG. 9 is an isometric view showing the boot hanger FIG. 8 used in the present boot hanger system.

FIGS. 8 and 9 show an alternate boot hanger embodiment 201 that enables the boot hanger 201 to be attached to or removed from the anterior side of the standalone coupler ladder rungs 23 and 25 or the coupler ladder extension rung 33 heretofore described above and shown in FIG. 3B. Referring first to FIG. 5 and its corresponding description, it can be seen that the side rails of the standalone coupler ladder 21, as well as the side rails of a coupler ladder extension 29 if used, prevent direct anterior side attachment of the boot hanger suspension portion 4 to the coupler ladder rungs 23 and 25, and rung 33 of a ladder extension. This is because the coupler ladder side rails 22*a* and 22*b* block the posterior ends 6 of the boot hangers 1 and prevent free passage of the boot hangers 1 from the posterior side to the anterior side of the X-X axis of suspension apparatus 2 (here a closet rod) if the suspension portions 4 (such as hooks) 4 are directly attached to coupler ladder rungs 23 and 25 from the anterior side of the X-X axis. In order to attach boot hangers 1 and 1*a* as shown in FIG. 5, or additional like boot hangers to ladder extensions 29, the boot hanger 1 hook-shaped suspension portion 4 and the counterbalance arm 5 must be inserted between the parallel side rails 22*a*, 22*b* with the boot hanger support legs 7*a* and 7*b* straddling the ladder side rails 22*a*, 22*b*. After passing between side rails 22*a* and 22*b* to the anterior side of suspension apparatus 2 or the X-X axis, the boot hanger suspension portion 4 is attached to the coupler ladder 20 by rungs 23, 25, etc., and alternatively the same process must be performed in reverse in order to withdraw a boot hanger 1 from said coupler ladders.

The alternate boot hanger embodiment shown in FIGS. 8 and 9 overcomes the above mentioned attachment problem by providing a boot hanger 201 comprising a suspension portion such as a hook shaped suspension portion 204 for attachment to a suspension apparatus such as closet rod 2 or a rung of a coupler ladder 20, such as rungs 23, 25, or 33, and a counterbalance 203 that includes spaced apart counterbalance arms 205*a* and 205*b* that extend in a reward direction from a "U" shaped anterior end 210 to respective "U" shaped posterior ends 206*a* and 206*b*. The counterbalance arms 205*a* and 205*b* are spaced apart to provide a gap that facilitates suspending the boot hangers from the rungs in the coupler ladder assembly 20. A first boot support leg 207*a* extends in a forward direction from "U" shaped posterior end 206*a* and terminates at an upward angled foot 208*a*. Likewise, a second boot support leg 207*b* extends in a forward direction from "U" shaped posterior end 206*b* and terminates at an upward angled foot 208*b*. Both boot support legs 207*a* and 207*b* are spaced apart from their respective counterbalance arms 205*a* and 205*b*. As shown in FIG. 9, boot hanger 201 can be attached to the coupler ladder rungs 23, 25, or 33 from the anterior side of rod 2 because the two spaced apart counterbalance arms 205*a* and 205*b* provide a gap with an open end 209 that enables the counterbalance arms to straddle the coupler ladder side rails when inserted from the anterior side.

Figure 10:
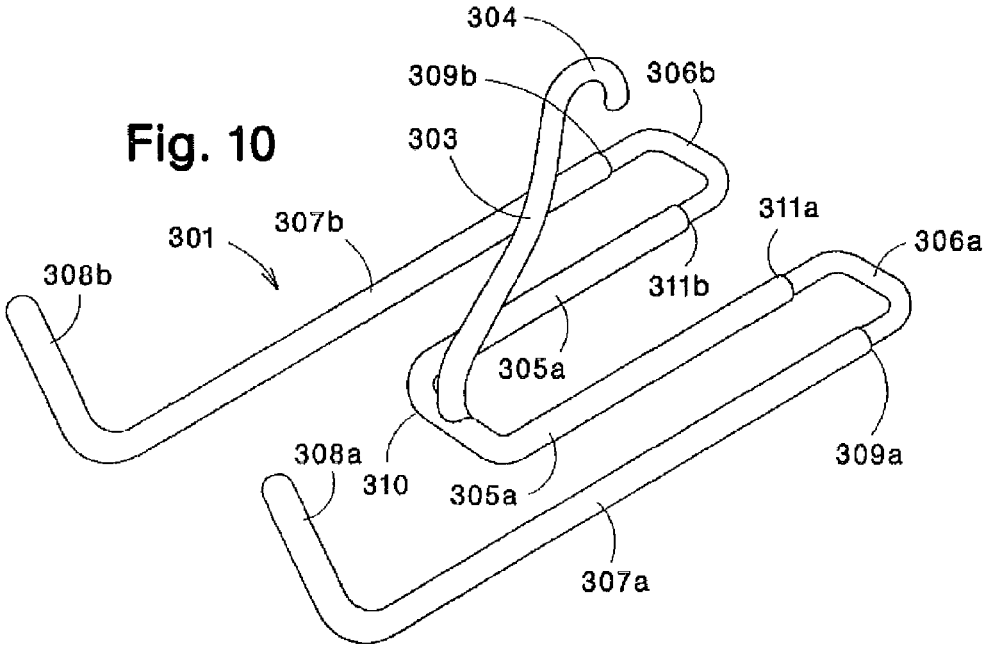
FIG. 10 is an isometric view of a boot hanger similar to FIG. 8 with adjustment to accommodate boot size and boot weight.

FIG. 10 shows an alternate boot hanger embodiment 301 similar to the boot hanger of FIG. 8 but with adjustment means to accommodate both boot size and boot weight to maintain the target slope angle theta Θ. As heretofore mentioned in the above embodiments, at least one boot hanger 301 is suspended along a vertical axis extending from a closet rod or the like. Boot hanger 301 includes a suspension portion such as a hook 304 and a counterbalance 303 comprising spaced apart counterbalance arms 305*a* and 305*b* that extend in a reward direction from a "U" shaped anterior end 310 to respective "U" shaped posterior ends 306*a* and 306*b*. Counterbalance arms 305*a* and 305*b* include a telescopic or slide connection 311*a* and 311*b* respectively that enables the length of each arm to be either increased or decreased to maintain target slope angle theta Θ in response to hung boot size and weight.

A first boot support leg 307*a* extends in a forward direction from "U" shaped posterior end 306*a* and terminates at an upward angled foot 308*a* along the anterior side of hook 304. In a similar manner, a second boot support leg 307*b* extends in a forward direction from "U" shaped posterior end 306*b* and terminates at an upward angled foot 308*b*. Both boot support legs 307*a* and 307*b* are positioned outboard from their respective counterbalance arms 305*a* and 305*b*, and both support legs 307*a* and 307*b* include a telescopic or slide connection 309*a* and 309*b* respectively that enables the length of support legs 307*a* and 307*b* to be either increased or decreased in response to boot size.

Figure 11:
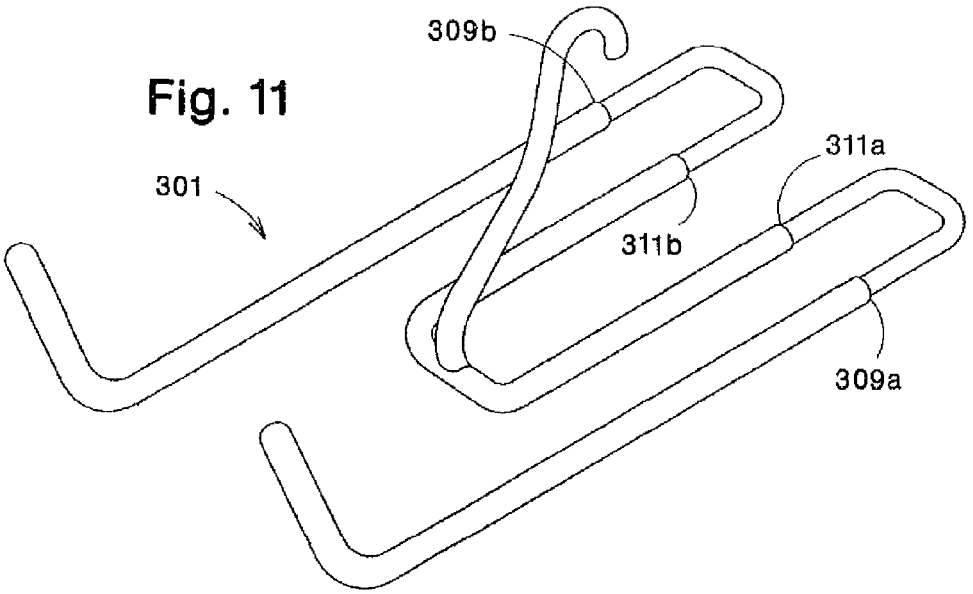
FIG. 11 is an isometric view of the boot hanger in FIG. 10 adjusted to accommodate both boot size and boot weight.

FIG. 11 shows the counterbalance arm slide connections 311*a* and 311*b* of boot hanger 301 adjusted for boot weight and boot size, and the support leg slide connections 309*a* and 309*b* adjusted for boot size.

Figure 12:
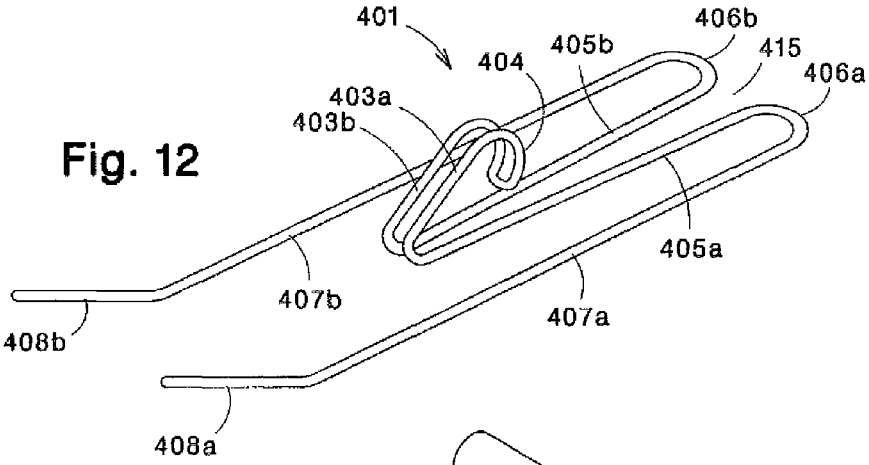
FIG. 12 is an isometric view showing an alternate boot hanger embodiment for use with a coupler ladder of FIG. 3B.

FIG. 12 shows another boot hanger embodiment 401 that enables direct anterior side attachment to the coupler ladder assembly 20 as herein described above. Boot hanger 401 comprises a pair of opposite hand structures for hanging boots and may be formed from a single bent bar or rod and includes a suspension portion such as a hook 404 formed in the shape of an open loop. Hook 404 divides the bar or rod into two equal halves that are formed into opposite hand boot hanger configurations. The first of the two configurations comprises a counterbalance 403*a* integral with hook 404 and includes a counterbalance arm 405*a* that extends from the anterior side of hook 404 in a reward direction to a "U" shaped posterior end 406*a*. A first boot support leg 407*a* extends in a forward direction from "U" shaped posterior end 406*a* and terminates at an upward angled foot 408*a* along the anterior side of looped hook 404. Likewise, the second or opposite configuration comprises a counterbalance 403*b* integral with hook 404 and includes a counterbalance arm 405*b* that extends from the anterior side of hook 404 in a reward direction to a "U" shaped posterior end 406*b*. A second boot support leg 407*b* extends in a forward direction from "U" shaped posterior end 406*b* and terminates at an upward angled foot 408*b* along the anterior side of looped hook 404. As heretofore mentioned above, boot hanger 401 may be attached to coupler ladder rungs from the anterior side of a coupler ladder assembly because the two spaced apart counterbalance arms 405*a* and 405*b* provide an open end 409 that enables the counterbalance arms to straddle the coupler ladder side rails when inserted from the anterior side.

Figure 13:
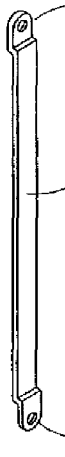
FIG. 13 is an isometric view showing a tie rod used in a string of suspended boot hangers.
Figure 14:
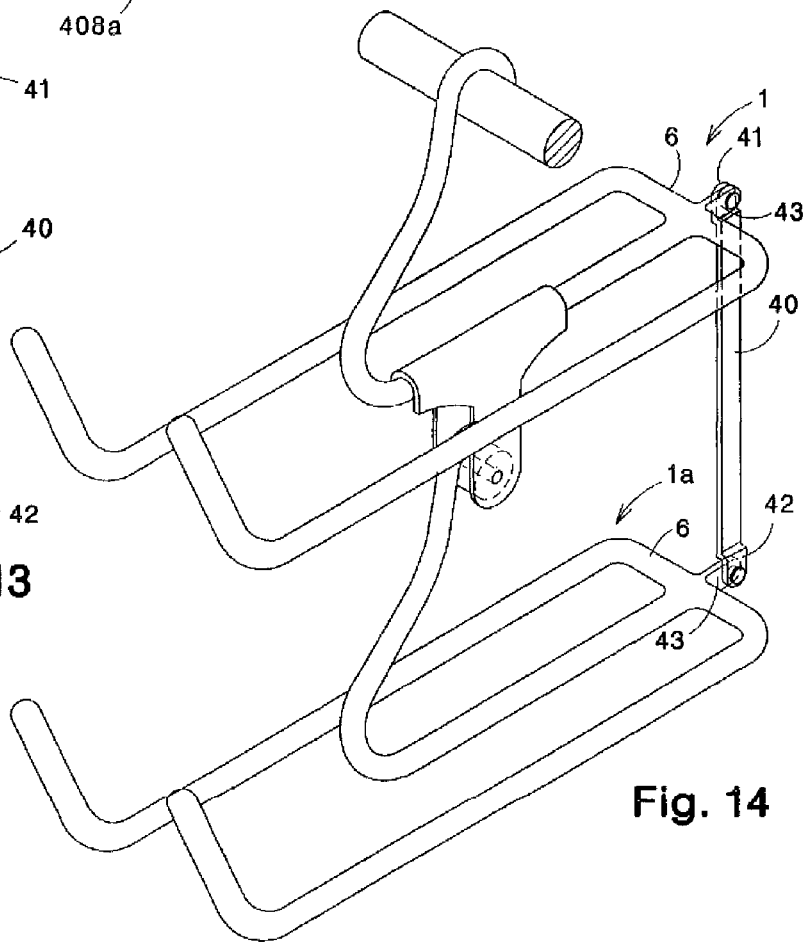
FIG. 14 is an isometric view showing the tie rod of FIG. 13 fastened to adjacent boot hangers.
Figure 15:
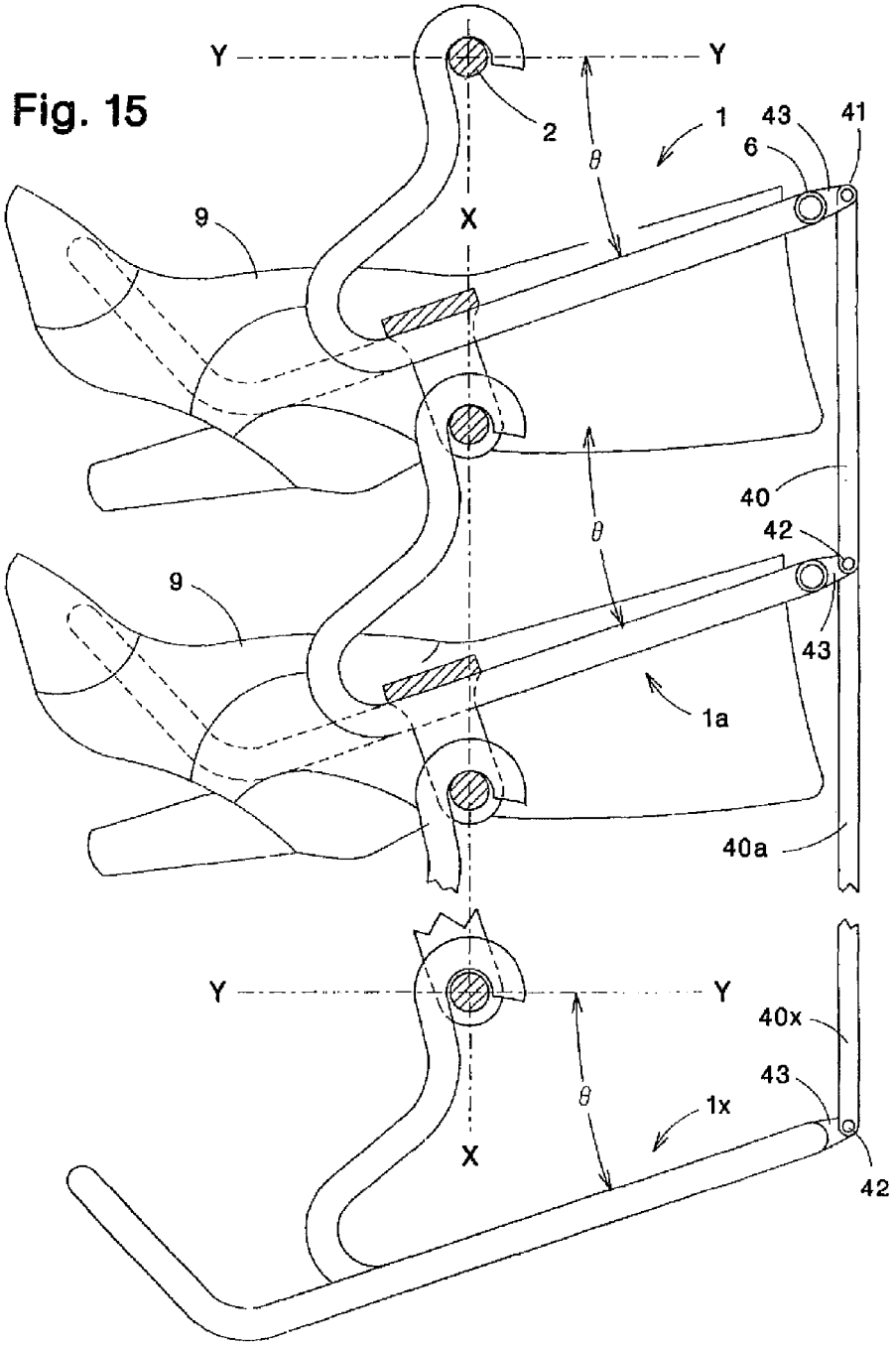
FIG. 15 is an elevation view in cross-section showing the tie rod of FIG. 13 used in a string of suspended boot hangers.

FIGS. 13, 14, and 15 show tie rods 40 used to align a string of suspended boot hangers 1-1*x* at a same target slope angle theta Θ irrespective of whether the boot hangers 1-1*x* are loaded or unloaded. Tie rod 40 comprises an elongated bar or rod that extends between a left hand connection end 41 and a right hand connection end 42. When used, the connection ends 41 and 42 of tie rod 40 are pivotally attached to tabs 43 that extend in an outward direction from the posterior end 6 of adjacent boot hangers, and the offset left and right connection ends 41 and 42 align tie rod 40 along the centerline of the pivot tabs 43 to eliminate or reduce torque or twisting between the connected boot hangers. Tie rods 40 are added to or removed from the boot hanger system to correspond with the addition or removal of boot hangers as boot storage needs change. In a string of suspended boot hangers as shown in FIG. 15, the chain of tie rods 40 through 40*x* cooperate and function similar to a parallelogram. The pivotally connected chain of tie rods cause each boot hanger 1 through 1*x* to rotate in unison into a target slope angle theta Θ whether or not the hangers are loaded with boots 9 as shown at hangers 1 and 1*a* or unloaded as shown at hanger 1*x*.

It should be understood, however, that although tie rods 40 are shown attached to the connection ends of a boot hanger similar to FIG. 1, such tie rods 40 may be attached to any of the boot hanger embodiments shown herein (including but not limited to FIGS. 1-8 and 12), and that the rods 40 may be provided as rigid or flexible, without departing from the scope of the present invention.

Figure 16:
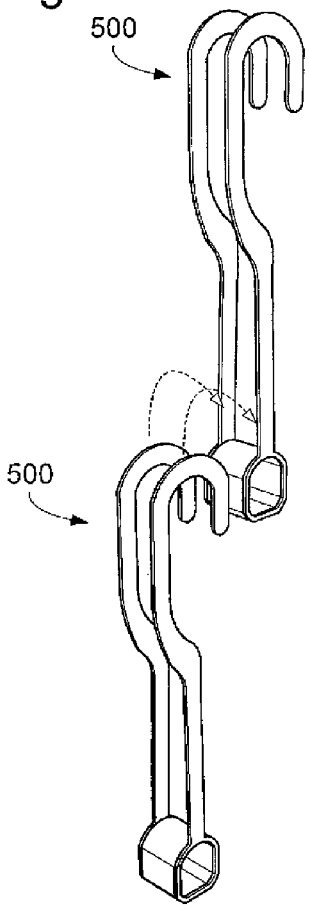
FIG. 16 is an isometric view showing an alternate coupler embodiment used in the present invention, and specifically showing the way in which said couplers attach to each other.
Figure 17:
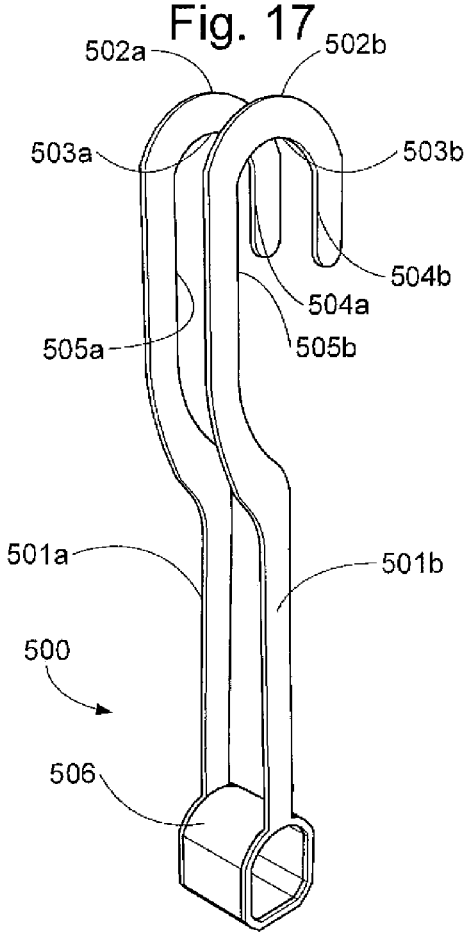
FIG. 17 is an isometric view showing an alternate coupler embodiment used in the present invention.

FIGS. 16 and 17 show yet another embodiment for use in the present invention. This universal and modular coupler ladder 500 can be added or removed from any string of suspended coupler ladders as storage needs change. Each coupler ladder 500 includes a pair of side rails 501*a* and 501*b* with suspension portions such as hooks 502*a* and 502*b* located proximate the upper ends of each side rail 501 and positioned to engage a closet rod, or alternatively to engage a rung 506 of another coupler ladder 500 when a plurality of coupler ladders 500 are connected to the ladder and hanger string assembly, or any component thereof. The receiving portion of hooks 502*a* and 502*b* includes concave upper surfaces 503*a* and 503*b* having a radius that accommodates connection to a closet rod or a rung 506 of another coupler ladder 500, and preferably having a radius substantially matching the largest common closet rods. At the posterior ends of concave upper surfaces 503*a* and 503*b*, vertical surfaces 504*a* and 504*b* extend downward towards rung 506 and at the anterior ends of concave upper surfaces 503*a* and 503*b*, vertical surfaces 505*a* and 505*b* extend downward towards rung 506; said vertical surfaces 504*a* and 504*b* and 505*a* and 505*b* are positioned opposite each other such that they lie anterior and posterior with respect to a closet rod or other suspension apparatus when hung from the same. Each coupler ladder 500 includes a rung 506 for supporting a boot hanger 1, 601 et seq. or another coupler ladder 500. Rung 506 extends between and is fixed to the side rails 501*a* and 501*b* proximate their bottom ends and is profiled and oriented to substantially match the receiving portion of hooks 502*a* and 502*b* such that the hooks 502*a* 502*b* fit with little play when hung from a rung 506 of another coupler ladder 500. The pairs of hooks 502*a*, 502*b* and corresponding shapes of the hook receiving portions and rung 506 are designed to provide stability of the suspended coupler ladder assembly 500 while accommodating the dimension and shape of most closet rods or other suspension apparatus in common use, thus providing a single coupler ladder apparatus that can be hung either from a closet rod or from another coupler ladder 500. Any number of coupler ladders 500 may be added to or removed from the assembly of one or more coupler ladders 500 as boot storage needs change.

Figure 18:
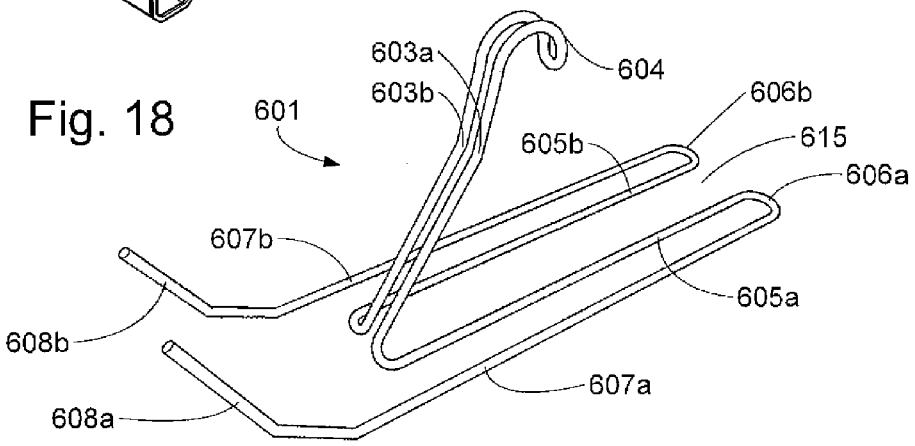
FIG. 18 is an isometric view showing an alternate boot hanger embodiment used in the present invention.

Referring to FIGS. 16, 17, 18, 19, and 20, another embodiment of the present boot hanger system comprises at least one boot hanger apparatus 601 suspended from a support such as closet rod 2. Similar to boot hanger embodiment 401, boot hanger 601 enables direct anterior side attachment to any of the coupler ladder embodiments described herein. Boot hanger 601 comprises a pair of opposite hand structures for hanging boots 9 and may be formed from a single length of bar or rod, bent to the desired shape and including a suspension portion such as a hook 604, preferably formed in the shape of an open loop as illustrated in FIG. 18. Hook 604 divides the length of bar or rod into two equal mirror-image portions to form opposite hand boot hanger portions of hanger 601. The first configuration comprises a first counterbalance assembly 603*a*, integral hook 604, and includes a counterbalance arm 605*a* that extends from the anterior side of hook 604 in a reward direction to a "U" shaped posterior end 606*a*. A first boot support leg 607*a* extends in a forward direction from "U" shaped posterior end 606*a* and terminates at an upward angled foot 608*a* along the anterior side of looped hook 604. Likewise, the second or opposite hand configuration comprises a counterbalance assembly 603*b* integral with hook 604 and includes a counterbalance arm 605*b* that extends from the anterior side of hook 604 in a reward direction to a "U" shaped posterior end 606*b*. A second boot support leg 607*b* extends in a forward direction from "U" shaped posterior end 606*b* and terminates at an upward angled foot 608*b* along the anterior side of looped hook 604. As heretofore mentioned above, boot hanger 601 may be attached to coupler ladder rungs (such as rung 506) from the anterior side of a coupler ladder assembly because the two spaced apart counterbalance arms 605*a* and 605*b* provide an open end 609 that enables the counterbalance arms to straddle the coupler ladder side rails 501*a*, 501*b* when inserted from the anterior side.

The counterbalance arms 605*a* and 605*b* and posterior end members 606*a* and 606*b*, along with posterior portions of support legs 607*a* and 607*b* control rotational force exerted on looped hook 604 when boots 9 (FIG. 19) are hung on the support legs 607*a* and 607*b* so that the entire loaded boot hanger 601 rotates about the support from which it is suspended, to a target downward inclined plane or slope angle. The combined length and weight of counterbalance arms 605*a* and 605*b*, posterior end member 606*a* and 606*b*, and the posterior portions of boot support legs 607*a* and 607*b* are predetermined so that boot hanger 601 is rotated to a downward inclined plane having a target slope angle theta Θ when loaded with boots as shown in FIG. 19. In its loaded condition, where legs 607*a* and 607*b* are within the shafts 9*a* of hanging boots with the angled feet 608*a* and 608*b* engaging the instep 9*b*, holding the toe 9*c* in an upward direction, as shown at boot hangers 601*a*, 601*c* and 601*x* in FIG. 19, a target slope angle theta Θ will vary depending upon the weight distribution of the boots 9 being supported but is preferably less than about 65 degrees below the horizontal axis Y-Y with a preferred target slope angle theta Θ of about 25 degrees, and preferably greater than about 1 degree. Such a preferred shallow target slope angle improves vertical storage space usage by allowing a greater number of boot hangers 601 to be suspended along a vertical axis X-X when compared to prior boot hanger devices as heretofore mentioned above. In an unloaded condition, without hung boots 9, as shown at boot hanger 601 and 601*b* in FIG. 19, the slope angle of a boot hanger 601 is less than the target slope angle identified as "<Θ". Boot hanger apparatus 601 is further configured to provide sufficient clearance for easy boot removal and insertion when multiple boot hangers 601 are suspended along vertical axis X-X, depicted here by boot hanger 601*d*, the boot support legs 607*a* and 607*b* are setout from the hook 604 causing said boot support legs 607*a*, 607*b* and by extension any boots 9 supported thereon, to move in a large arc when a boot hanger 601 rotates about the support apparatus 2 from which it is suspended, thereby causing the upward angled feet 608*a* and 608*b* and the front portion of boot support legs 607*a* and 607*b* to move forwards and upwards facilitating easy boot 9 insertion and removal despite immediately adjacent boot hangers 601 positioned above and/or below.

Figure 21:
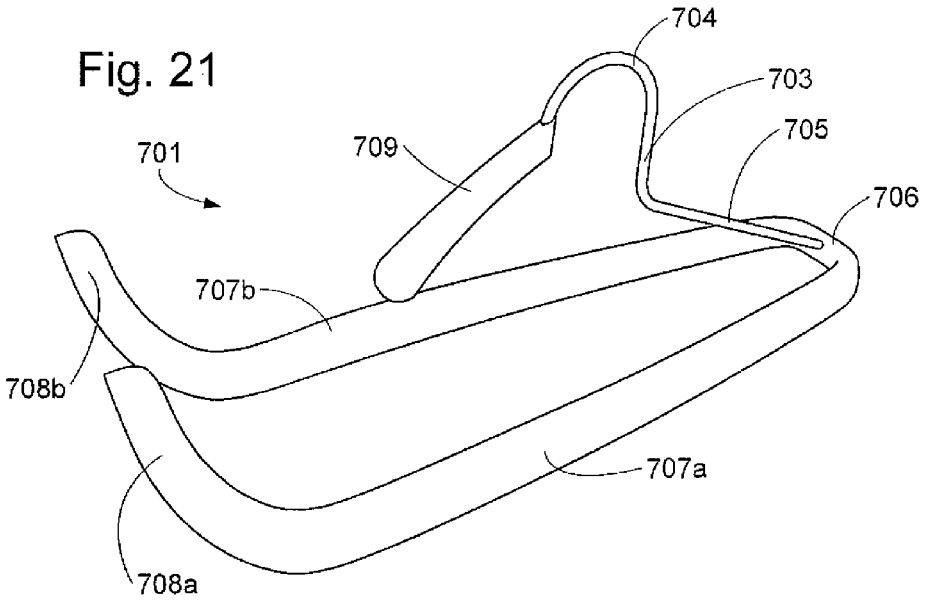
FIG. 21 is an isometric view showing an alternate boot hanger embodiment for use in the present invention.
Figure 21A:
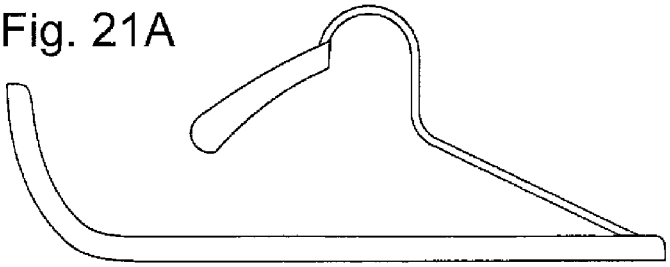
FIG. 21A is a right side orthographic view of the boot hanger shown in FIG. 21.
Figure 21B:
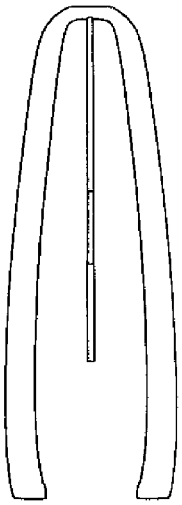
FIG. 21B is a top plan view of the boot hanger shown in FIG. 21.
Figure 21C:
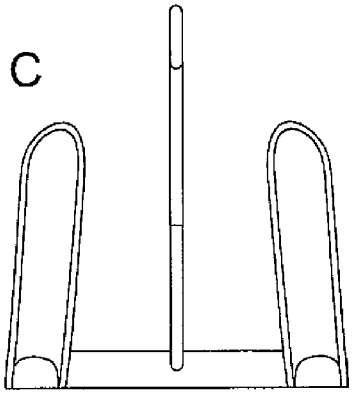
FIG. 21C is a front elevation view of the boot hanger shown in FIG. 21.

Referring to FIGS. 21-21C, another embodiment of the present boot hanger system comprises at least one boot hanger apparatus 701 suspended from a support apparatus such as closet rod 2. Boot hanger embodiment 701 may be molded from plastic, various metals, or any other suitably strong, stiff and durable material; it may be molded in one piece or as several separate pieces which are then assembled into a complete boot hanger 701. Said boot hanger may be used either individually or in conjunction with any other couplers disclosed herein. Boot hanger 701 is further differentiated from the other embodiments, in that its counterbalance 703 follows a more direct path from the suspension portion 704 (here a hook) to the posterior end member 706, thereby simplifying the appearance of boot hanger 701 and reducing the amount of material consumed in its manufacture. It should be noted that the more direct path followed by the counterbalance 703 in boot hanger 701 can be incorporated into any other embodiment disclosed herein without departing from the scope of the invention.

Boot hanger 701 includes a suspension portion such as hook 704 shaped to engage and attach the boot hanger 701 to a support apparatus such as a closet rod 2 or the like, the hook 704 being interconnected and preferably integrally fashioned with counterbalance 703 originating from the posterior side of the hook 704. The counterbalance 703 extends in a downward and backward direction with respect to hook 704 to a "T" shaped posterior end member 706 positioned along the posterior side of hook 704. The "T" shaped posterior end member 706 is attached to a first boot support leg 707*a* that extends in a forward direction and includes an upward angled foot 708*a* positioned along the anterior side of hook 704 at a location outboard from counterbalance 703, and a second boot support leg 707*b* that extends in a forward direction and includes an upward angled foot 708*b* positioned along the anterior side of hook 704 at a location outboard from counterbalance 703. Boot support leg 707*a* is spaced apart from support leg 707*b*. For this embodiment, posterior end member 706, boot support legs 707*a* and 707*b* and upturned angled feet 708*a* and 708*b* are substantially convex on their upper surfaces and substantially concave on their under surfaces such that they could be easily removed from a mold and in order to maximize the stiffness of the parts while keeping the amount of material used in their making to a minimum. While not explicitly depicted in the figures, it is anticipated that such a molded embodiment may also incorporate ribs, gussets and/or other features to increase the stiffness of some parts. Further, some parts may be molded while other may be cut, bent or thermoformed and different parts may be constructed of different materials. For example, the posterior end member 706, support legs 707*a* and 707*b* and upward angled feet 708*a* and 708*b* may be molded from plastic while the hook 704 and counterbalance assembly 703 may be bent from metal rod and then attached to the rest of the boot hanger assembly, all without departing from the scope of the present invention.

Both the support legs 707*a* and 707*b* and the upward angled feet 708*a* and 708*b* include effective lengths so that legs 707*a* and 707*b* adequately support the shafts of hanging boots 9 while the angled feet 708*a* and 708*b* engage the insteps, holding the toe in an upward direction and preventing the boots 9 and their internal sides and/or shafts from sliding along the support legs 707*a*, 707*b* so that the boots are resiliently retained on the hanger and boot shape is maintained.

The counterbalance 703 and posterior end member 706, along with posterior portions of support legs 707*a* and 707*b* control rotational force exerted on hook 704 when boots 9 are hung on the support legs 707*a* and 707*b* so that the entire loaded boot hanger 701 rotates about its point of suspension to a target downward inclined plane or slope angle Θ. The combined geometry and weights of counterbalance assembly 703, posterior end member 706, and the posterior portions of boot support legs 707*a* and 707*b* and the center of mass of the suspended boot hanger 701 are predetermined so that boot hanger 701 is rotated to a downward inclined plane having a target slope angle theta Θ when loaded with boots. As further illustrated in FIG. 21, a handle portion 709 is optionally provided to assist a user in utilizing the hanger 701. The handle portion 709 is preferably attached to the suspension portion of the hanger 701, such as the hook-shaped portion 704, but can also be attached to other portions such as the counterbalance portion 705. The handle portion 709 preferably extends in the same anterior direction as the legs 707 and feet 708.

Figure 22:
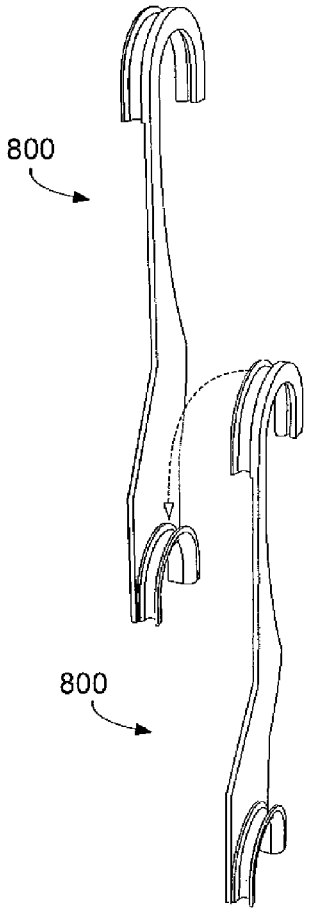
FIG. 22 is an isometric view showing two instances of an alternate coupler embodiment used in the present invention, and specifically showing the way in which the couplers attach to each other.
Figure 23:
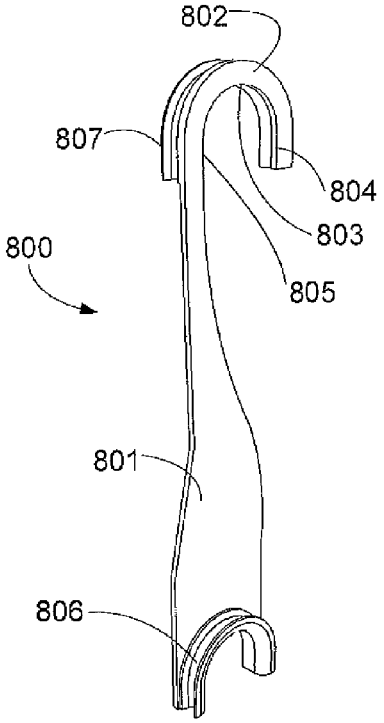
FIG. 23 is an isometric view showing an alternate coupler embodiment used in the present invention.
Figure 24:
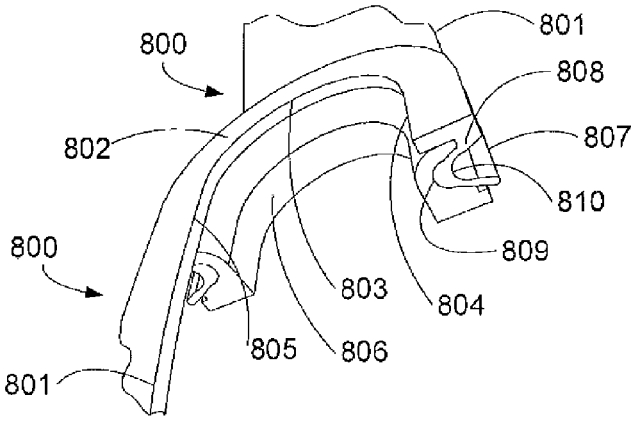
FIG. 24 is a fragmentary view showing an alternate coupler embodiment used in the present invention, and specifically showing the joint where two like couplers attach to each other.

FIGS. 22, 23 and 24 show yet another embodiment of the present invention. Similar to other coupler ladders described herein, this coupler ladder 800 can be added or removed from a string of suspended coupler ladders 800 as a user's boot storage needs change. Each coupler ladder 800 includes a rail 801 with a suspension portion such as hook 802 located proximate the upper end of rail 801 and positioned to engage a closet rod (or other suspension apparatus), or alternatively to engage a rung 806 of another coupler ladder 800, such as when a plurality of coupler ladders 800 are connected in series to form a ladder assembly. As shown, the receiving portion of hook 802 includes concave upper surface 803 having a radius that accommodates connection to a suspension apparatus such as a closet rod or a rung 806 of another coupler ladder 800, and preferably having a radius substantially matching the largest commonly used closet rods. At the posterior end of concave upper surface 803, vertical sidewall surface 804 extends downward towards rung 806, and at the anterior end of concave upper surface 803, vertical sidewall surface 805 extends downward towards rung 806. Said vertical surfaces 804 and 805 are positioned opposite each other such that they lie anterior and posterior with respect to a closet rod when hung from the same. Hook 802 is further configured with an offset portion 807, such as the portion extending horizontally towards the left and fixed on its right side to the left side of hook 802. As shown in FIG. 24, offset portion 807 has a cross section 808 with a substantially convex inner edge 809 and a substantially concave outer edge 810. Said outer edge 810 of cross section 808 forms a channel along the outer circumference of offset portion 807 and is configured for attachment to the suspension portion of a hanger such as hanger 701 shown in FIG. 21, by way of non-limiting example. Said inner edge 809 of cross section 808 forms a ridge along the inner circumference of upper offset portion 807. Each coupler ladder includes a rung 806 for attachment to a boot hanger 701 or another coupler ladder 800. Rung 806 extends horizontally towards the right and is fixed at its left side to the right side of rail 801 proximate its bottom end, and is configured to substantially match the receiving portion of hook 802 and the inner circumference of offset portion 807 such that the hook 802 and associated offset portion 807 fits with little play when attached to a rung 806 of another coupler ladder 800. Coupler ladder 800 is preferably further configured such that offset portion 807 is centered on rung 806 on both the frontal and sagittal planes, therefore rail 801 crosses the frontal plan from right to left as it extends downwards to its connection on the left side of rung 806. The corresponding shapes of the hook 802 receiving portion, its offset portion 807 and the rung 806 are designed to provide stability to the entire suspended coupler ladder assembly (including interconnected hangers 701 and couplers 800 with boots 9), while accommodating the dimension and shape of most suspension apparatus such as closet rods 2 in common use, thus providing a coupler ladder 800 that can be hung either from a closet rod 2 or from another coupler ladder 800. Any number of coupler ladders 800 may be added to or removed from the coupler ladder assembly to adapt as boot storage needs change.

It should be further understood that within the embodiments described herein it has been contemplated that while boot hangers are likely to be hung frequently from a closet rod other supports that possess sufficient strength are at an appropriate height to suspend the desired number of boots on boot hangers would be equally suitable; such alternative supports could include but are not limited to couplers, hooks, pins, nails, bolts, shelves, lashings, ropes, cables, chains, clothes lines, trees, limbs, joists, rods, tubes, loops, rings, ball joints, among others.

Even though many of the embodiments herein describe suspending the boot hanger apparatus 1, 101, et seq. oriented so that the upward angled feet 8*a*, 8*b*, 108*a*, 108*b*, et seq. of the support legs 7*a*, 7*b*, 107*a*, 107*b*, et seq. are "anterior" (i.e. facing the open front of a closet and therefore with boot soles facing out towards a user), it is fully contemplated that the apparatus can be suspended in an opposite configuration. For example, the apparatus can be suspended so that the upward angled feet of each support leg (and therefore the soles of any boots hung thereon) face away from a user (i.e. towards the back of a closet). In the latter case, the hangers preferably do not include a handle portion 709 (FIG. 21), and the hook 4, 104, et seq. is preferably oriented to receive a suspension apparatus 2, 102 et seq. on the side facing the upward angled feet such as is depicted in FIGS. 1A and 21-21C; said hook orientation need not prevent a user from using the boot hanger apparatus with the upward angled feet positioned anterior.

All of the boot hanger embodiments disclosed herein are intended for use either individually or with the use of coupler slings, coupler ladders or other suitable means of vertically coupling multiple boot hangers along axis X-X. The suspension portion used for suspending said boot hangers from a closet rod or other suspension apparatus may have its opening oriented forward or rearward. For example, a hook-shaped suspension portion may alternatively be replaced with any suitable means of suspending said boot hangers and couplers in a vertical orientation known in the art, without departing from the disclosed invention.

Thus, specific compositions and methods of a boot hanger optionally for use in a boot hanger system that suspends a series or "string" of boot hangers and optionally couplers, the boot hangers preferably held at a target slope angle theta Θ along a common vertical axis have been disclosed. Of course, those skilled in the art may contemplate various changes, modifications, and alterations from the teachings of the present disclosure without departing from the intended spirit and scope of the inventive concepts herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. While the principles of the invention have been described above in connection with preferred embodiments, it is to be clearly understood that this description is made only by way of example and not as a limitation of the scope of the invention.

The invention claimed is:

1. A boot hanger system for hanging boots, the boot hanger system comprising:

at least two boot hanger apparatuses, each boot hanger apparatus for hanging respective first and second boots, each boot having an instep and a foot insertion opening, each of the boot hanger apparatuses comprising:

an upper suspension portion;

left and right boot support legs, each of the left and right boot support legs having an upturned foot portion configured to support the boot by the instep when the support leg is inserted into the boot; and wherein the upper suspension portion and boot support leg are connected by a counterbalance, such that when the boot support leg is inserted into the boot and the boot support leg is suspended using the upper suspension portion, the boot is swingingly suspended in an off-vertical position with the upturned foot portion angled upward; and a coupler, comprising:

a first engagement portion configured to engage with at least one of a first boot hanger apparatus from the at least two boot hanger apparatuses and a suspension apparatus; and a second engagement portion configured to engage with a second boot hanger apparatus from the at least two boot hanger apparatuses, such that the first boot hanger is suspended above the second boot hanger when a boot is swingingly suspended on the first boot hanger and a boot is swingingly suspended on the second boot hanger;

wherein the distance between the first and second engagement portions of the coupler is such that the vertical distance between a boot support leg of the first boot hanger apparatus and a corresponding boot support leg of the second boot hanger apparatus when engaged with the coupler is less than the length of the boot support legs.

2. The boot hanger system of claim 1, wherein the counterbalance further operates to maintain the boot support leg within a desired offset angle (Θ) from a horizontal plane when a boot is placed on the boot support leg.

3. The boot hanger system of claim 2, wherein the offset angle Θ is less than about 65 degrees from the horizontal plane.

4. The boot hanger system of claim 2, wherein the offset angle Θ is less than the angle of the upturned foot portion.

5. The boot hanger system of claim 1, wherein the boot support legs are setout from an axis of rotation by greater than about 13 centimeters.

6. The boot hanger system of claim 1, wherein the overall length is greater than about 39 centimeters when measured along the horizontal plane of the support legs.

7. The boot hanger system of claim 1, wherein the overall length is greater than about 45 centimeters when measured along the horizontal plane of the support legs.

8. The boot hanger system of claim 1, wherein the upturned foot portion extends to greater than about 6 centimeters above the position of the boot support leg when said boot support leg is oriented along a horizontal plane.

9. The boot hanger system of claim 1, wherein the upturned foot portion extends to greater than about 8 centimeters above the position of the boot support leg when said boot support leg is oriented along a horizontal plane.

10. The boot hanger system of claim 1, wherein the upturned foot portion has an offset angle greater than about 25 degrees above a horizontal plane.

11. The boot hanger system of claim 1, wherein the upturned foot portion has an offset angle greater than about 45 degrees above a horizontal plane.

12. The boot hanger system of claim 1, further comprising a handle portion.

13. The boot hanger system of claim 1, the counterbalance further comprising a telescopic counterbalance arm configured to change in length.

14. The boot hanger system of claim 1, each of the left and right support legs further comprising a telescoping connection configured to change in length.

15. The boot hanger system of claim 1, wherein the first engagement portion comprises a saddle portion configured to engage the counterbalance of the first boot hanger apparatus and the second engagement portion comprises a stub configured to engage the upper suspension portion of the second boot hanger apparatus.

16. The boot hanger system of claim 1, wherein the first engagement portion comprises a first rung configured to engage the upper suspension portion of the first boot hanger and the second engagement portion comprises a second rung configured to engage the upper suspension portion of the second boot hanger.

17. The boot hanger system of claim 1, wherein the coupler comprises a sling comprising a continuous loop having a first inside diameter configured to engage the counterbalance of the first boot hanger apparatus and a second inside diameter configured to engage the upper suspension portion of the second boot hanger apparatus.

18. The boot hanger system of claim 1, wherein the first engagement portion comprises a hook portion configured to engage with the suspension apparatus and the second engagement portion comprises a rung configured to engage the upper suspension portion of the second boot hanger apparatus.

* * * * *